US010615536B2

(12) United States Patent
Kobayashi et al.

(10) Patent No.: US 10,615,536 B2
(45) Date of Patent: Apr. 7, 2020

(54) ELECTRIC CABLE COVER AND CONNECTOR

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); TOYOTA JIDOSHA KABUSHIKI KAISHA, Toyota-shi, Aichi (JP)

(72) Inventors: Hiroki Kobayashi, Yokkaichi (JP); Yasuo Omori, Yokkaichi (JP); Teruo Hara, Yokkaichi (JP); Hisashi Kojima, Yokkaichi (JP); Hajime Kawase, Yokkaichi (JP); Masaaki Tabata, Yokkaichi (JP); Takeshi Misaiji, Seto (JP); Hiroshi Kobayashi, Okazaki (JP)

(73) Assignees: AUTONETWORKS TECHNOLOGIES, LTD. (JP); SUMITOMO WIRING SYSTEMS, LTD. (JP); TOYOTA JIDOSHA KABUSHIKI KAISHA (JP)

( * ) Notice: Subject to any disclaimer, the term of this patent is extended or adjusted under 35 U.S.C. 154(b) by 0 days.

(21) Appl. No.: 16/249,940

(22) Filed: Jan. 17, 2019

(65) Prior Publication Data

US 2019/0221962 A1 Jul. 18, 2019

(30) Foreign Application Priority Data

Jan. 18, 2018 (JP) ..... 2018-006630

(51) Int. Cl.
*H01R 13/58* (2006.01)
*H01R 13/56* (2006.01)

(52) U.S. Cl.
CPC ..... *H01R 13/5804* (2013.01); *H01R 13/56* (2013.01); *H01R 13/58* (2013.01)

(58) Field of Classification Search
CPC ..... H01R 13/5804; H01R 13/56; H01R 13/58
(Continued)

(56) References Cited

U.S. PATENT DOCUMENTS 4,900,277 A * 2/1990 Inaba ..... H01R 13/56 439/465
6,478,609 B1 * 11/2002 Davis ..... H01R 13/5812 439/465

(Continued)

FOREIGN PATENT DOCUMENTS

| | | |
|---|---|---|
| JP | 61-008952 | 1/1986 |
| JP | 2002-025684 | 1/2002 |
| JP | 2006-73326 | 3/2006 |

*Primary Examiner* — Alexander Gilman
(74) *Attorney, Agent, or Firm* — Gerald E. Hespos; Michael J. Porco; Matthew T. Hespos

(57) ABSTRACT

An electric cable cover that is to be mounted on a connector housing and that covers an electric cable led out from the connector housing includes a plurality of split covers that are connectable to each other. The plurality of split covers each includes: a base part that is to be attached to the connector housing; a hinge with flexibility that is formed to be integrated with the base part; and a rotation part that is contiguous to the hinge and rotates using a rotation axis of the hinge as a center. In a state where the plurality of split covers are connected to each other, a border region between the base part and the rotation part is provided at a different position for each of the plurality of split covers.

4 Claims, 38 Drawing Sheets

(58) Field of Classification Search
USPC ..... 439/470
See application file for complete search history.

(56) References Cited

U.S. PATENT DOCUMENTS

| | | | | |
|---|---|---|---|---|
| 6,568,967 | B2 | 5/2003 | Inaba et al. | |
| 6,663,411 | B2 * | 12/2003 | Little | H01R 13/501 439/188 |
| 7,001,204 | B1 * | 2/2006 | Lin | H01R 4/2433 439/418 |
| 7,140,905 | B2 * | 11/2006 | Castaldo | H01R 13/5833 439/410 |
| 7,413,464 | B1 * | 8/2008 | Chen | H01R 4/2433 439/404 |
| 7,476,121 | B2 * | 1/2009 | Tsuji | H01R 13/4223 439/465 |
| 7,918,684 | B2 * | 4/2011 | Lu | H01R 4/2433 439/395 |
| 7,967,642 | B2 * | 6/2011 | Schoene | H01R 4/2433 439/660 |
| 8,192,224 | B2 * | 6/2012 | Schmidt | H01R 24/64 439/409 |
| 8,215,980 | B1 * | 7/2012 | Lin | H01R 4/2433 439/404 |
| 8,568,159 | B2 * | 10/2013 | Noda | H01R 13/5812 439/470 |
| 9,130,283 | B1 * | 9/2015 | Lin | H01R 13/5841 |
| 9,553,402 | B2 * | 1/2017 | Thelen | H01R 13/502 |
| 9,960,535 | B2 * | 5/2018 | Kida | H01R 13/5219 |
| 10,033,118 | B2 * | 7/2018 | Jager | H01R 4/2433 |
| 2002/0009932 | A1 | 1/2002 | Inaba et al. | |
| 2019/0067874 | A1 * | 2/2019 | Saitoh | H01R 13/629 |

* cited by examiner

ELECTRIC CABLE COVER AND CONNECTOR

CROSS REFERENCE TO RELATED APPLICATION

This application claims priority from Japanese Patent Application No. 2018-006630 filed on Jan. 18, 2018. The entire contents of the priority application are incorporated herein by reference.

BACKGROUND

Field of the Invention

The technology described herein relates to an electric cable cover and a connector to which this electric cable cover is attached.

Related Art

One known example of an electric cable cover for a connector that covers an electric cable led out from a connector housing is disclosed in Japanese Unexamined Patent Application Publication No. 2006-73326 (FIG. 6). This electric cable cover includes a cover main body that is assembled to an end part of a connector housing where an electric cable is led out, and a pair of covers that is rotatably linked to the cover main body through a hinge.

In the aforementioned technology, a border region between the cover main body and one of the pair of covers and a border region between the cover main body and the other of the pair of covers are disposed at the corresponding positions.

In the above technology, when an external force is applied to one of the pair of covers, the cover to which the external force is applied will rotate using a rotation axis of the hinge as a center. As described above, the border region between the cover main body and one of the pair of covers and the border region between the cover main body and the other of the pair of covers exist at the corresponding positions. Therefore, the other cover cannot support the one cover that would rotate, and each cover rotates using the rotation axis of the hinge as the center.

Thus, since each of the pair of covers rotates using the rotation axis of the hinge as the center, the electric cable cover according to the conventional technology is easily deformed and enough strength cannot be obtained, which is a problem.

SUMMARY

The technology described herein was made in view of the above circumstances. An object is to increase the strength of the electric cable cover.

The technology described herein is an electric cable cover that is to be mounted on a connector housing and that covers an electric cable led out from the connector housing. The electric cable cover includes a plurality of split covers that are connectable to each other. The plurality of split covers each include: a base part that is to be attached to the connector housing; a hinge with flexibility that is formed to be integrated with the base part; and a rotation part that is contiguous to the hinge and rotates using a rotation axis of the hinge as a center. In a state where the plurality of split covers are connected to each other, a border region between the base part and the rotation part is provided at a different position for each of the plurality of split covers.

A connector according to the technology described herein includes the electric cable cover described above, and a connector housing on which the electric cable cover is mounted.

By the above configuration, even in a case where a force in a direction of rotating the rotation part is applied to the rotation part of one of the plurality of split covers that are connected to each other, the force can be received by the base part and the rotation part of the other split cover. Thus, the rotation part that has received the force rotates less easily with the other rotation part that is connected. As a result, the deformation of the electric cable cover as a whole can be suppressed and accordingly, the strength of the electric cable cover can be improved.

The border region between the base part and the rotation part refers to, if the base part and the rotation part are in contact with each other, a region where the base part and the rotation part are in contact with each other, and if the base part and the rotation part are separated, a region where the base part and the rotation part are opposed to each other.

Preferred aspects of the technology described herein are as described below.

Preferably, the border region between the base part and the rotation part may be provided at a position displaced in regard to a direction intersecting with the rotation axis of the hinge.

By the above configuration, in the case where the force in the direction of rotating the rotation part is applied to the rotation part of one of the plurality of split covers that are connected to each other, the rotation of the rotation part that has received the force can be prevented for sure by the other base part or rotation part disposed to be displaced in the direction intersecting with the rotation axis of the rotation part.

Preferably, in the state where the plurality of split covers are connected to each other, the hinge may be provided at a different position for each of the plurality of split covers.

In the above configuration, the rotation axis of the hinge is different for each of the split covers. Therefore, even in the case where the force in the direction of rotating the rotation part is applied to one rotation part, the rotation of the rotation part that has received the force along the same trajectory as the other rotation part can be suppressed because the rotation axis of the other rotation part is provided at a position different from the rotation axis of the rotation part that has received the force. As a result, the deformation of the electric cable cover as a whole can be suppressed and accordingly, the strength of the electric cable cover can be improved.

Preferably, the hinge provided to each of the plurality of split covers may be provided at a position displaced in regard to a direction intersecting with the rotation axis of the hinge.

By the above configuration, the rotation axis of the rotation part is displaced in regard to the direction intersecting with the rotation axis for each of the plurality of split covers that are connected to each other. Therefore, in the case where the force in the direction of rotating the rotation part is applied to one rotation part, the rotation of the rotation part that has received the force can be suppressed by the other base part or rotation part. As a result, the deformation of the electric cable cover as a whole can be suppressed and accordingly, the strength of the electric cable cover can be improved.

Preferably, one of the base part and the rotation part may include an engaging part, and the other of the base part and the rotation part may include an engaged part that is engaged with the engaging part.

By the above configuration, the base part and the rotation part are firmly connectable to each other through the engagement between the engaging part and the engaged part. Therefore, the strength of the electric cable cover can be improved further.

Preferably, at least one of the plurality of split covers may include a clamping part that clamps the electric cable between the clamping part and the other of the plurality of split covers in contact with the electric cable in the state where the plurality of split covers are connected to each other.

By the above configuration, in the state where the plurality of split covers are connected to each other, the electric cable is clamped between the clamping part provided to the one of the split covers and the other of the split covers. Even if an external force is applied to the electric cable, this external force can be received by this clamping part. Therefore, the strength of the electric cable cover can be improved further.

According to the technology described herein, the strength of the electric cable cover can be improved.

DETAILED DESCRIPTION

First Embodiment

Figure 1:
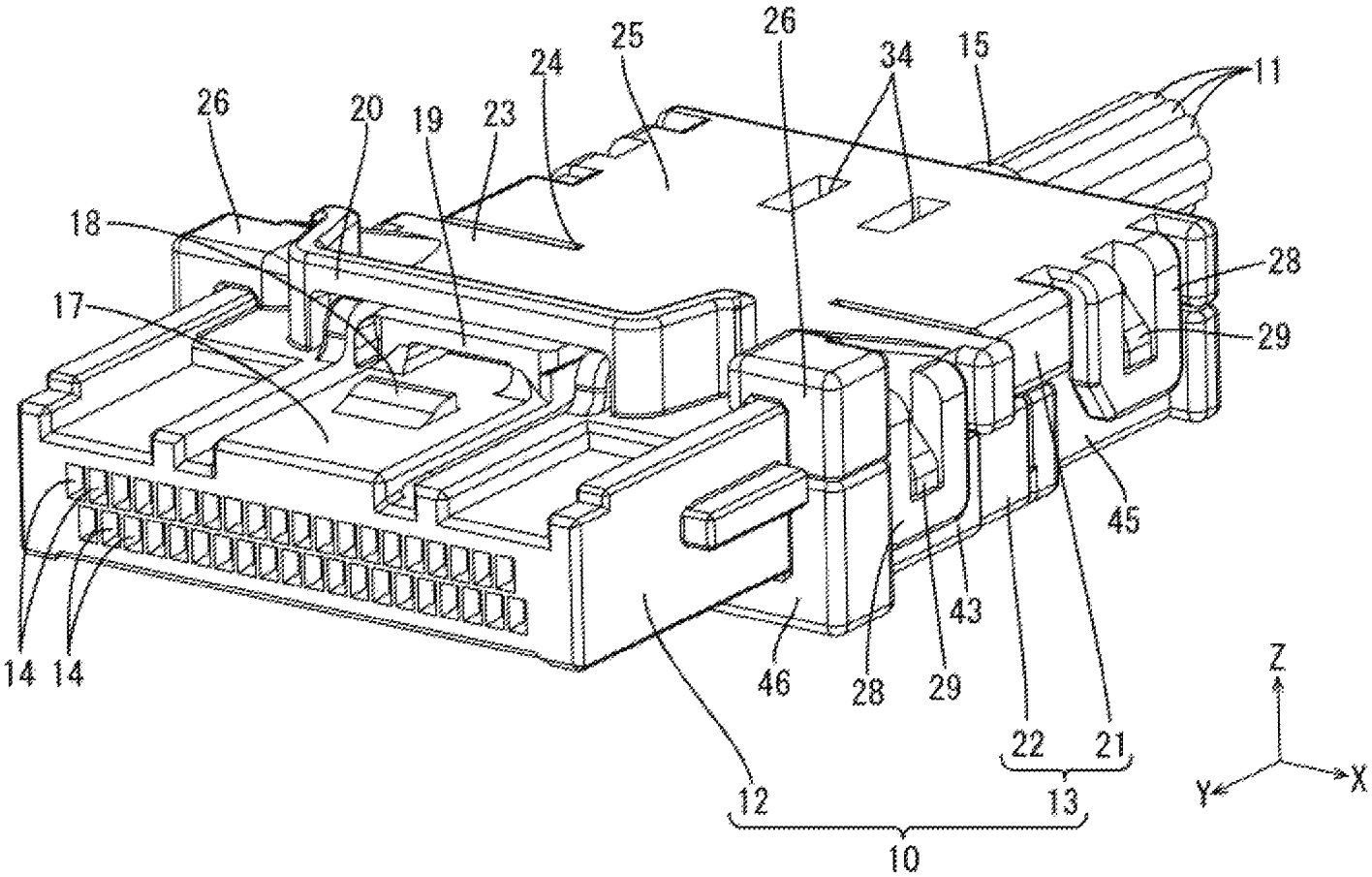
FIG. 1 is a perspective view illustrating a connector according to a first embodiment.

A first embodiment of the technology described herein will be described with reference to FIG. 1 to FIG. 21. As illustrated in FIG. 1, a connector 10 according to the present embodiment includes a connector housing 12 from which electric cables 11 are led out, and an electric cable cover 13 that is to be attached to the connector housing 12 and covers the electric cables 11. In the description below, a Z direction is an upward direction, a Y direction is a direction to the front, and an X direction is a direction to the left. Moreover, in the description below, a plurality of members that are the same may be denoted by one reference sign and the reference signs and description of the other members may be omitted.

Connector 10

Figure 2:
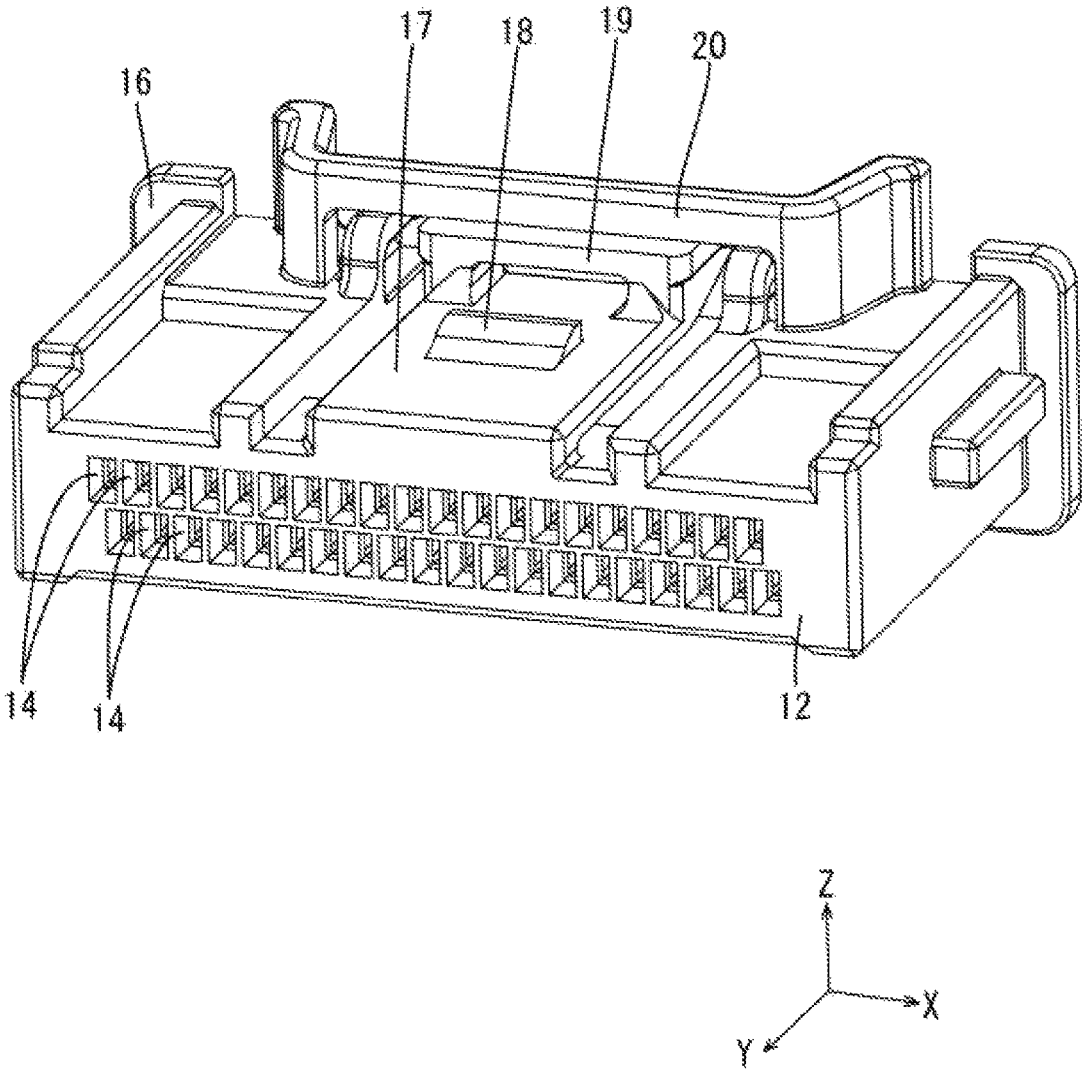
FIG. 2 is a perspective view illustrating a connector housing.

As illustrated in FIG. 2, the connector housing 12 is formed of insulating synthetic resin, and has a substantially rectangular parallelepiped shape that is flat vertically. A plurality of cavities 14 that is extended in a front-back direction is provided to the connector housing 12 with a space therebetween in a left-right direction, and the cavities 14 are arranged in two stages with a space in an up-down direction. The cavity 14 is open to the front and to the back. The cavity 14 houses a terminal that is not shown. The terminal is connected to an end of the electric cable 11 by a known method such as crimping, welding, or soldering. The electric cable 11 in the present embodiment is formed by covering an outer periphery of a metal conductor (not shown) with an insulating coating.

A plurality of the electric cables 11 are led out to the back from a rear end part of the connector housing 12. In other words, the electric cables 11 are led out to the back from the cavities 14 that open to the back. The electric cables 11 are bundled into one by winding of a tape 15 (see FIG. 20).

Figure 3:
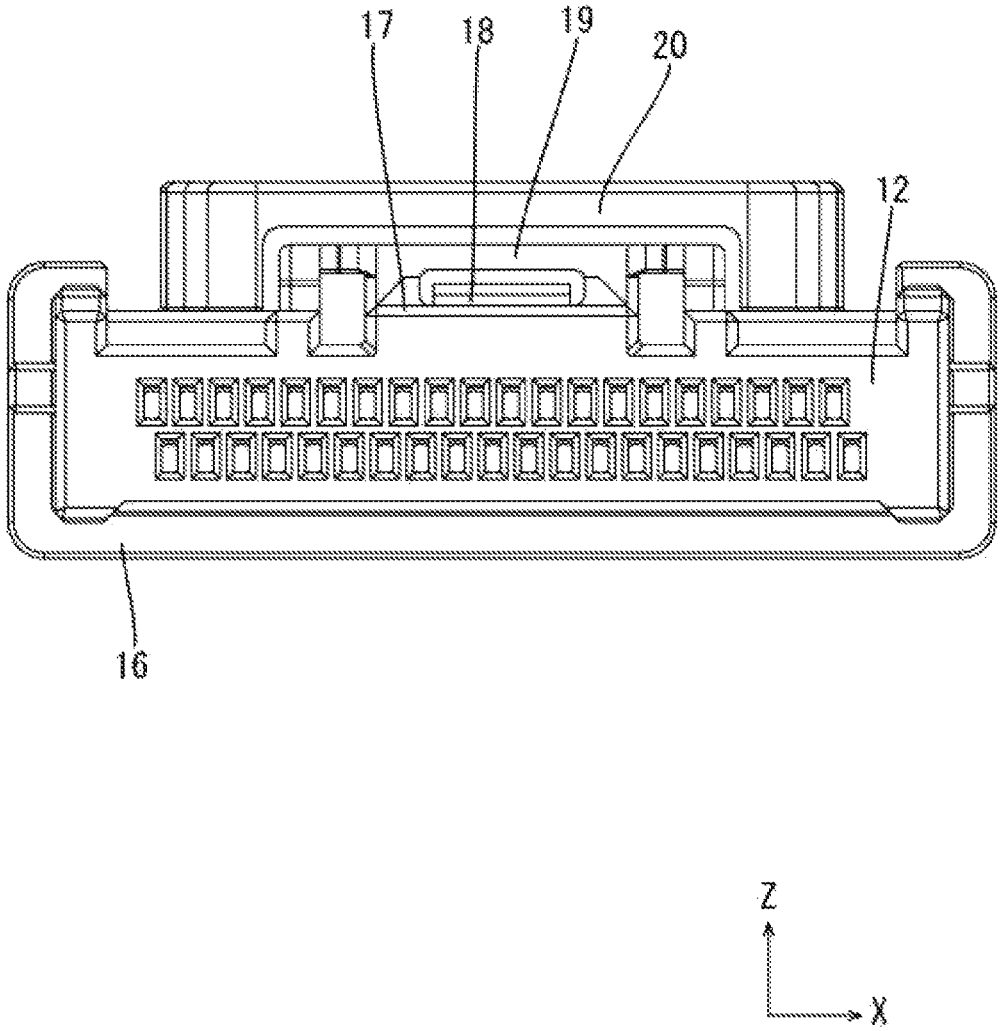
FIG. 3 is a front view illustrating the connector housing.

As illustrated in FIG. 3, an end rib 16 that projects in the up-down direction and the left-right direction is provided to the rear end part of the connector housing 12. On an upper surface of the connector housing 12, the end rib 16 is provided to left and right end parts of the connector housing 12. At left and right side surfaces of the connector housing 12, the end rib 16 is provided to the entire region in the up-down direction. On a lower surface of the connector housing 12, the end rib 16 is provided to the entire region in the left-right direction.

On the upper surface of the connector housing 12, a lock arm 17 that is elastically deformable is formed to extend to the back from a front end part of the connector housing 12. On an upper surface of the lock arm 17, a lock part 18 is formed to project upward. A grip part 19 with a plate-like shape that is extended in the left-right direction is provided to a rear end part of the lock arm 17. An operator putting his finger into this grip part 19 can make the lock arm 17 elastically deformed.

On the upper surface of the connector housing 12, a protective rib 20 is formed. The protective rib 20 is disposed at the front, and the left and right sides of the lock arm 17 and projects upward. The projecting height of the protective rib 20 from the connector housing 12 is set to be larger than the projecting height of the lock arm from the upper surface of the connector housing 12.

Electric Cable Cover 13

Figure 4:
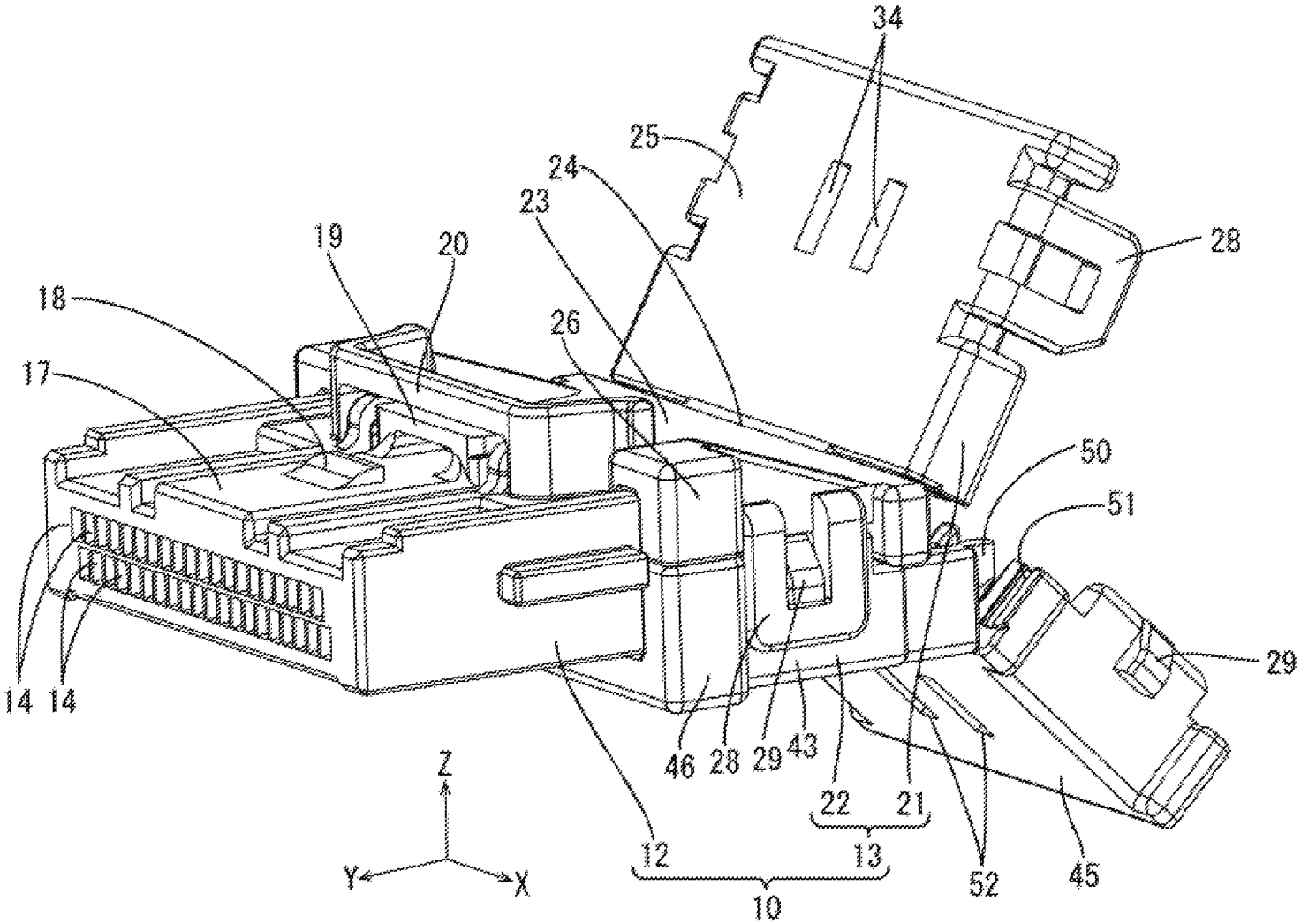
FIG. 4 is a perspective view illustrating a state where a first cover and a second cover are attached to the connector housing.
Figure 5:
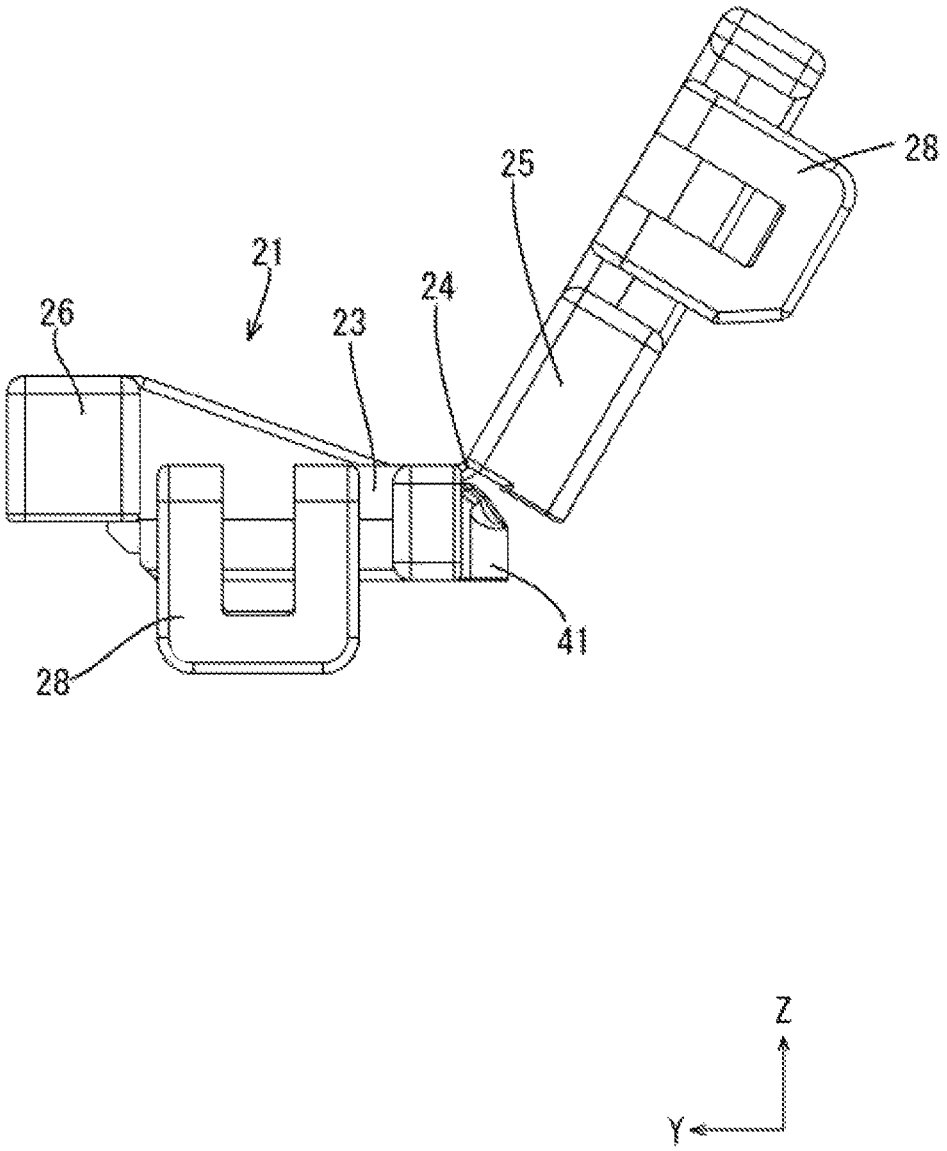
FIG. 5 is a side view illustrating the first cover in a state where a first rotation part is rotated.
Figure 6:
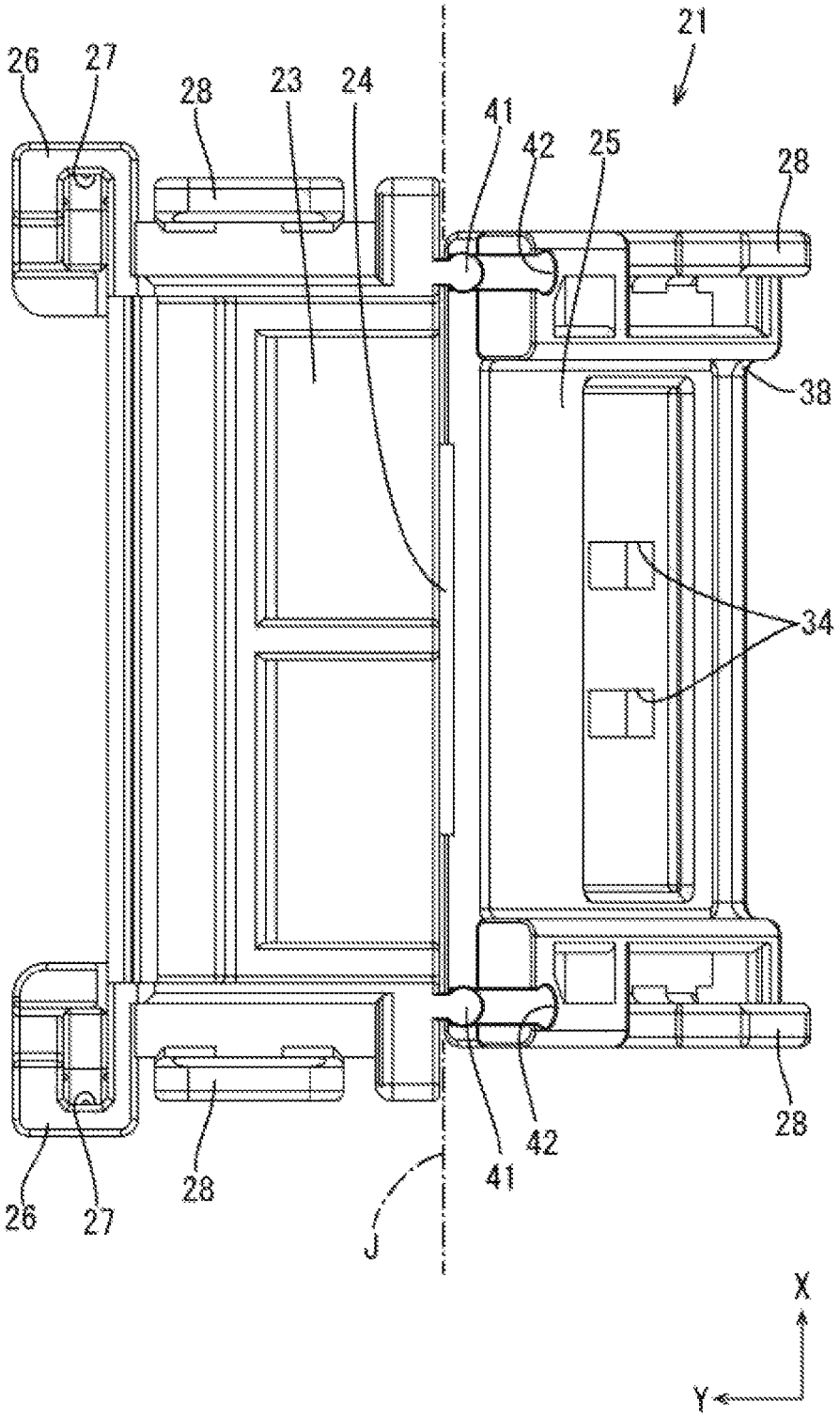
FIG. 6 is a bottom view illustrating the first cover in the state where the first rotation part is rotated.
Figure 7:
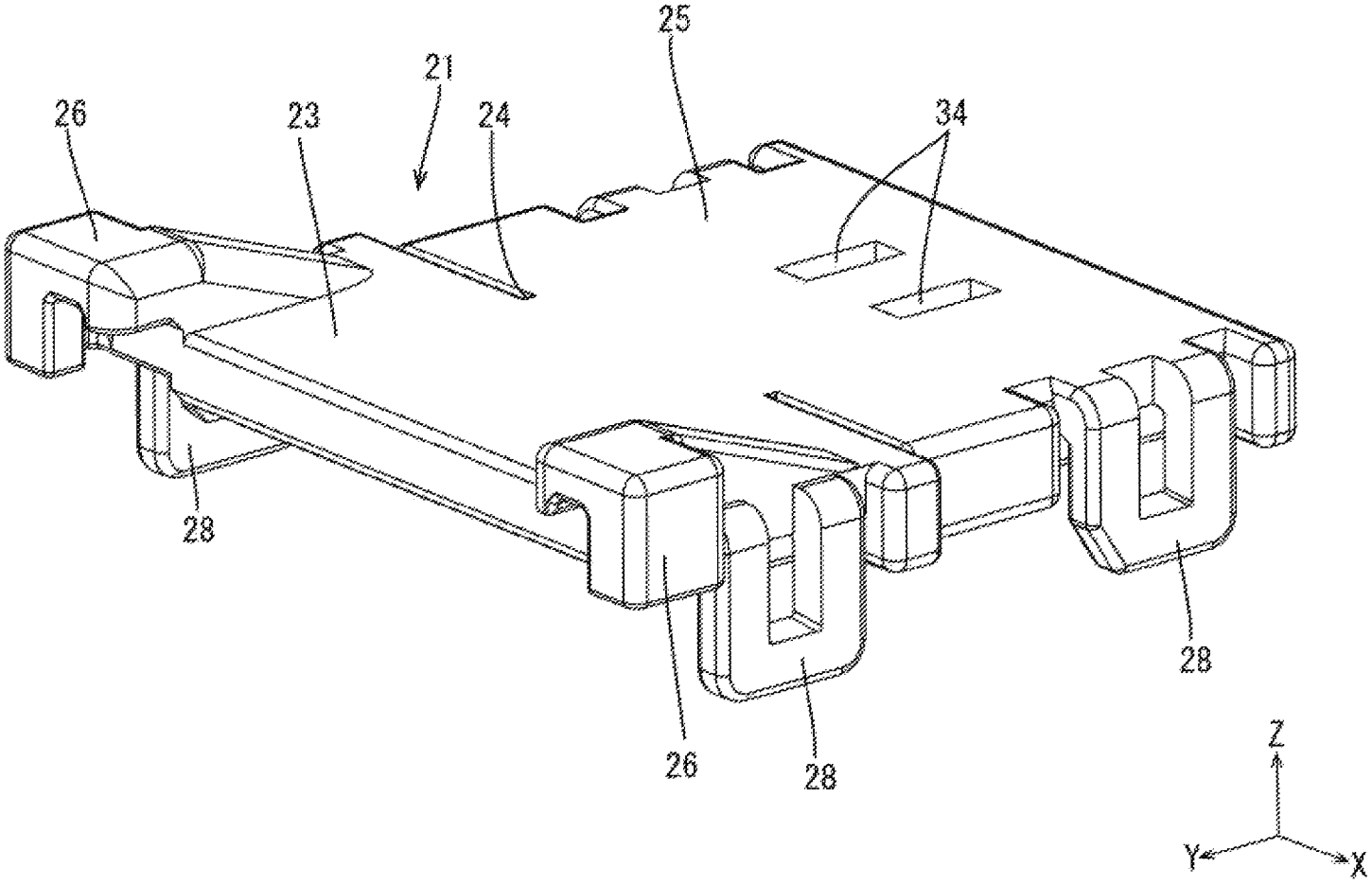
FIG. 7 is a perspective view illustrating the first cover in a state where a first engaging part and a first engaged part are engaged.
Figure 8:
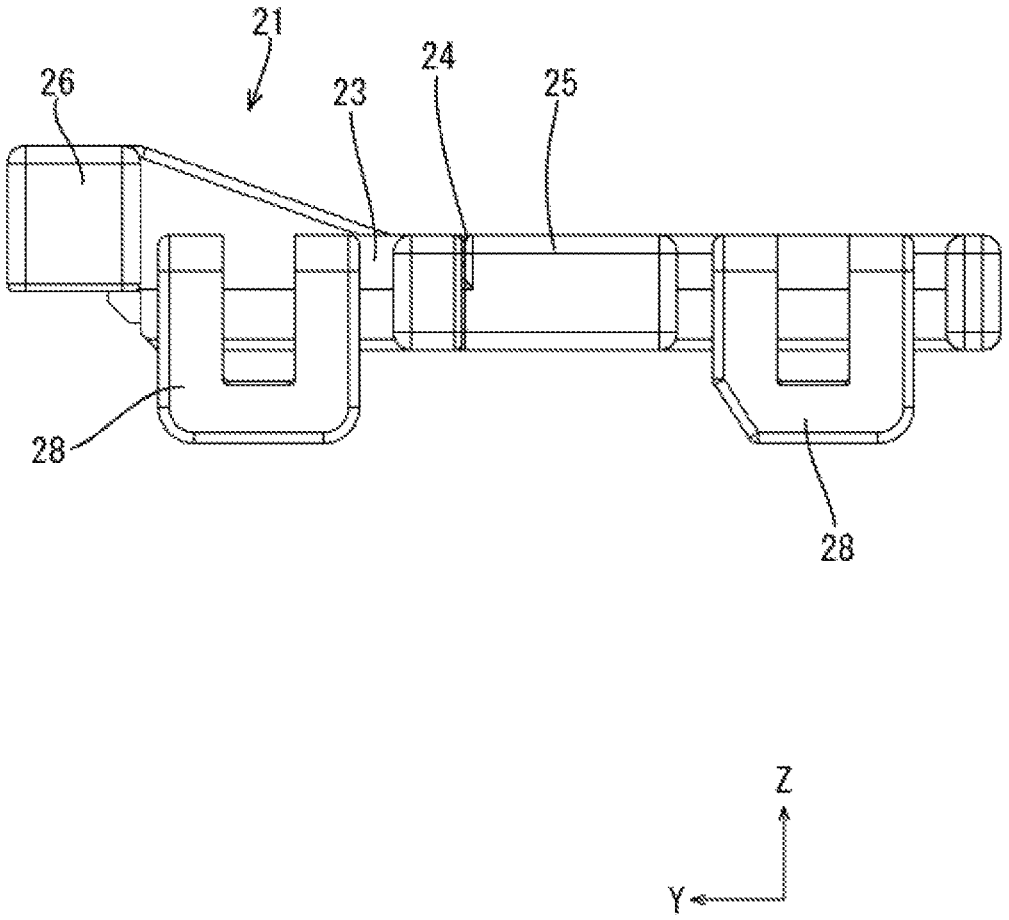
FIG. 8 is a side view illustrating the first cover in the state where the first engaging part and the first engaged part are engaged.
Figure 9:
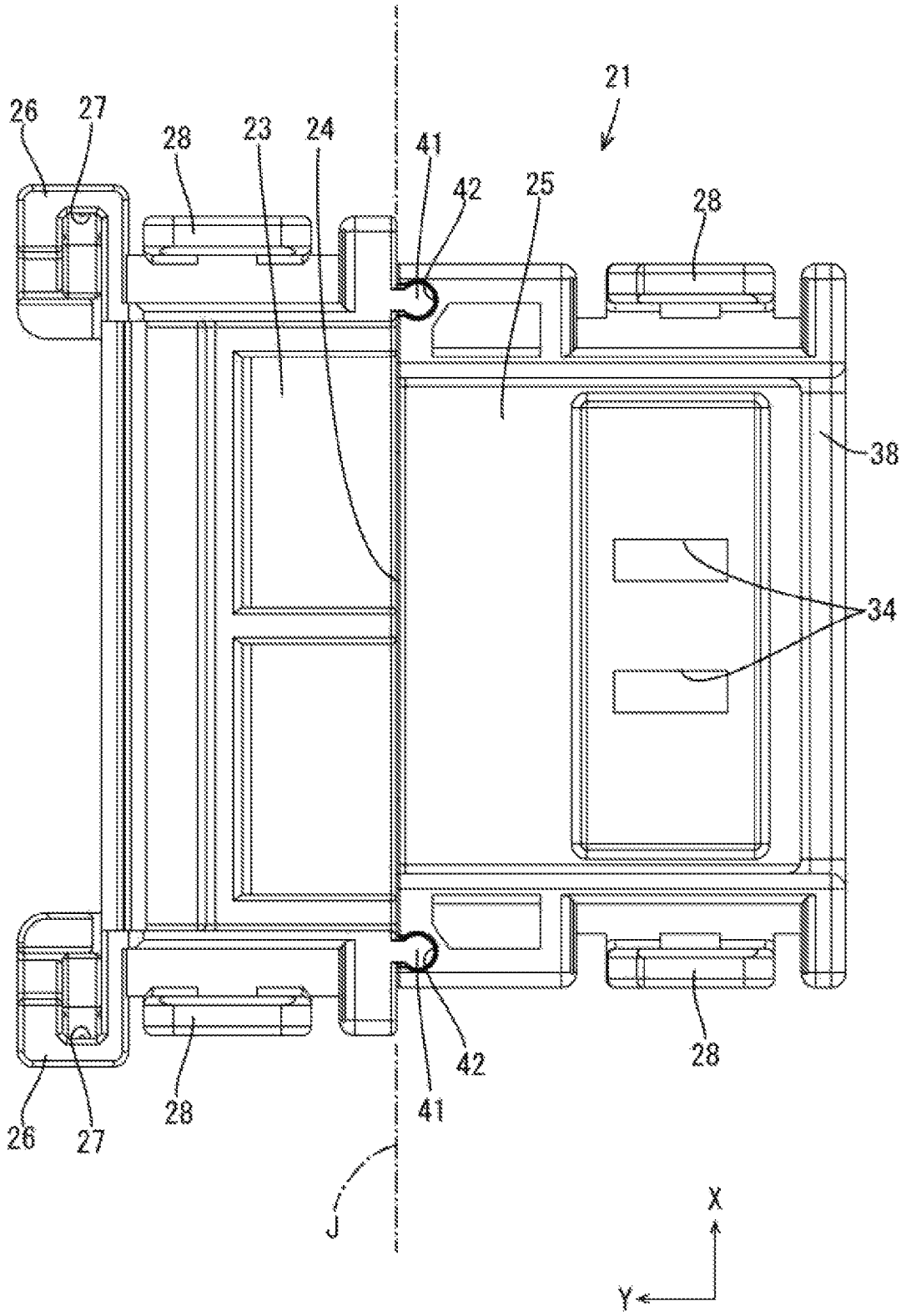
FIG. 9 is a bottom view illustrating the first cover in the state where the first engaging part and the first engaged part are engaged.
Figure 10:
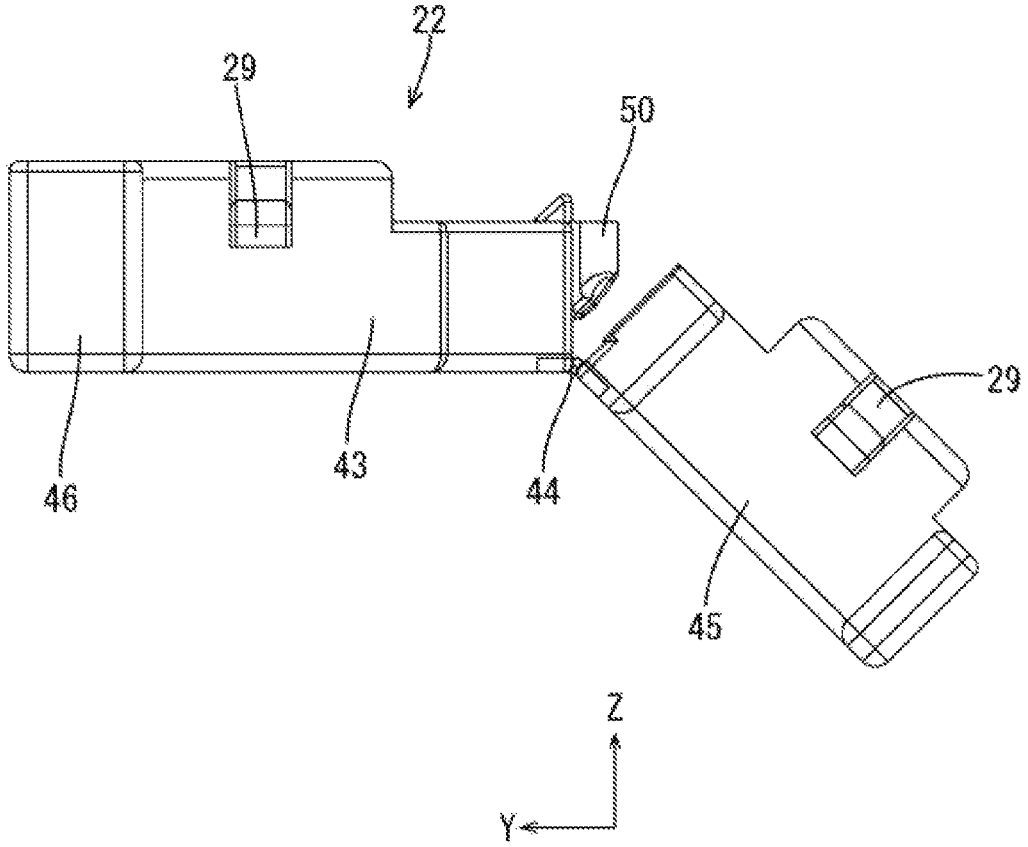
FIG. 10 is a side view illustrating the second cover in a state where a second rotation part is rotated.
Figure 11:
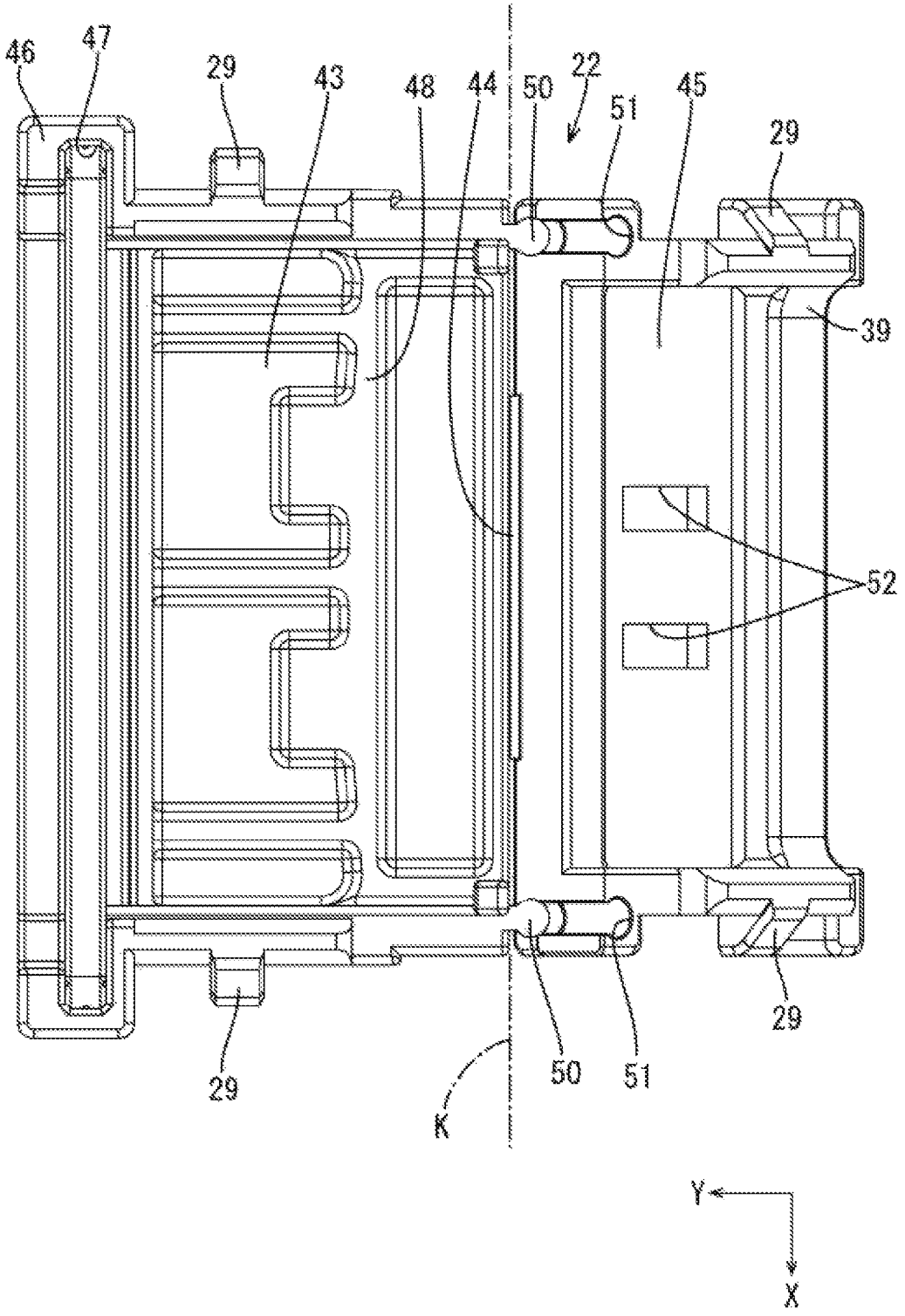
FIG. 11 is a plan view illustrating the second cover in the state where the second rotation part is rotated.
Figure 12:
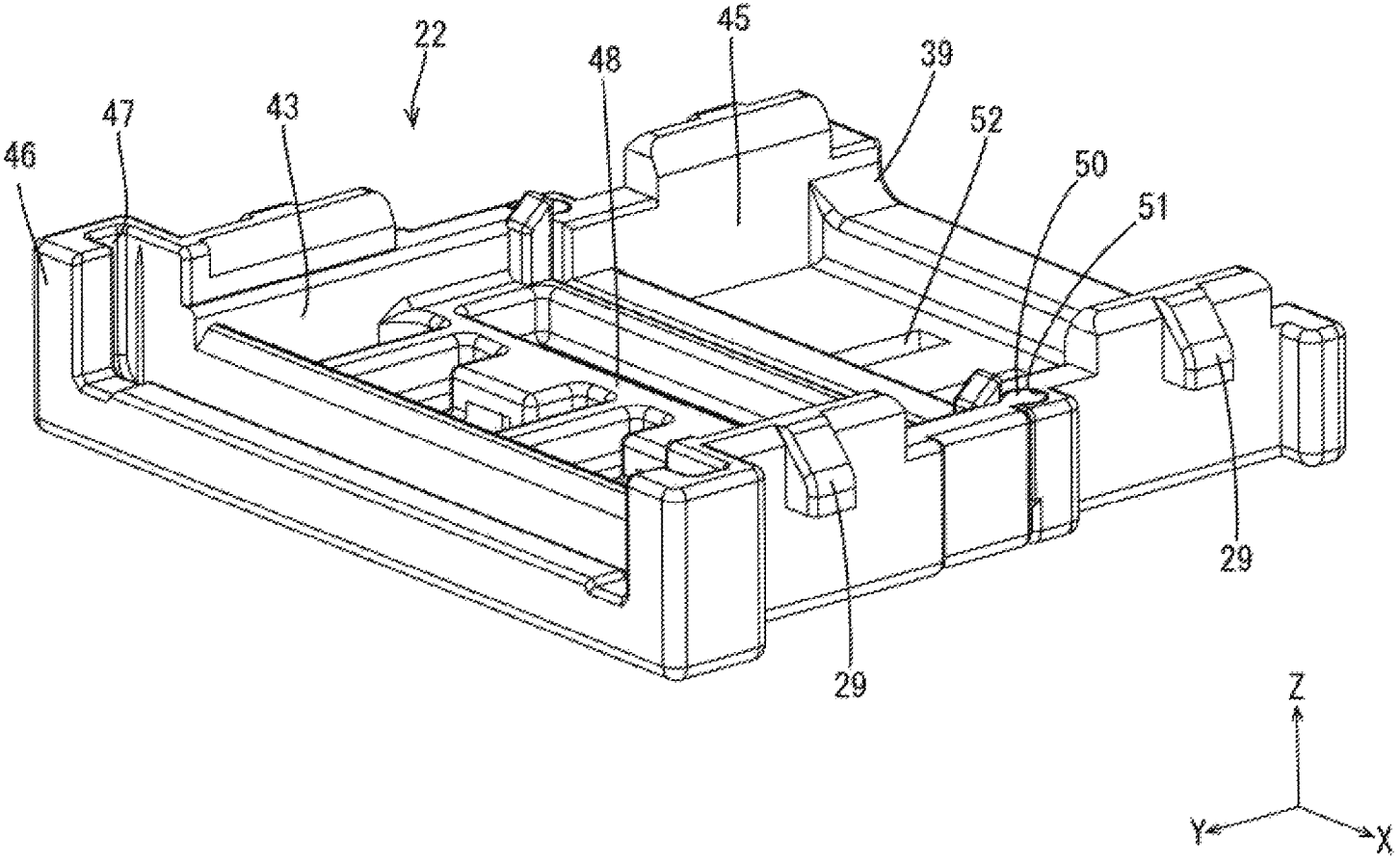
FIG. 12 is a perspective view illustrating the second cover in a state where a second engaging part and a second engaged part are engaged.
Figure 13:
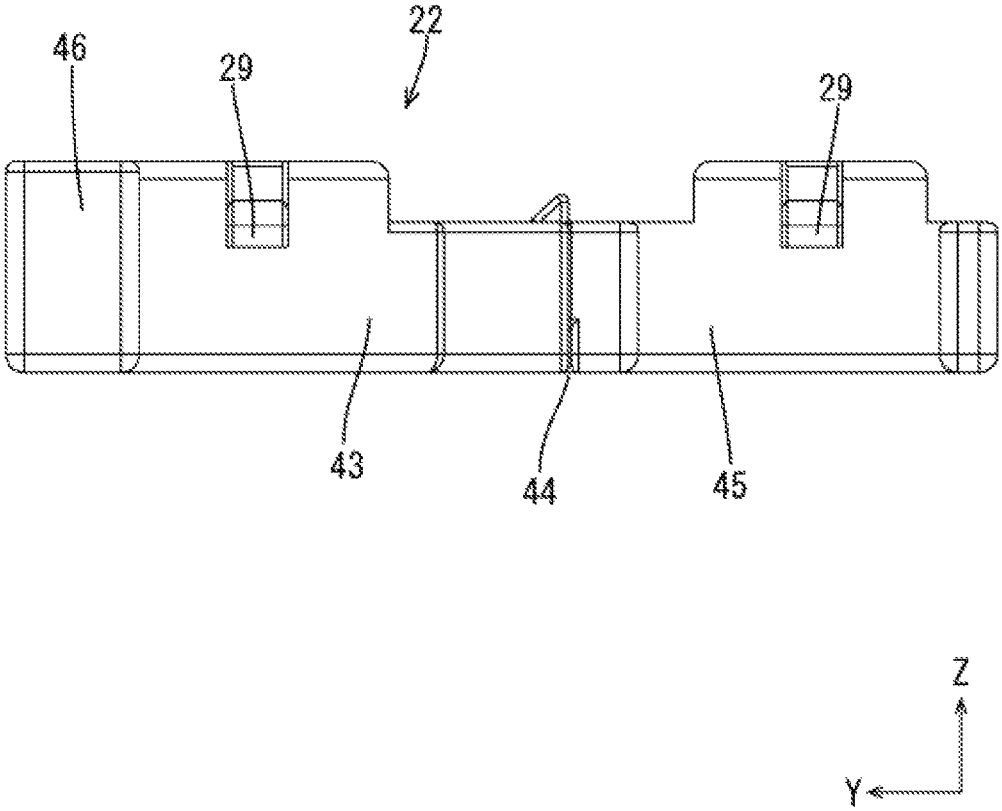
FIG. 13 is a side view illustrating the second cover in the state where the second engaging part and the second engaged part are engaged.
Figure 14:
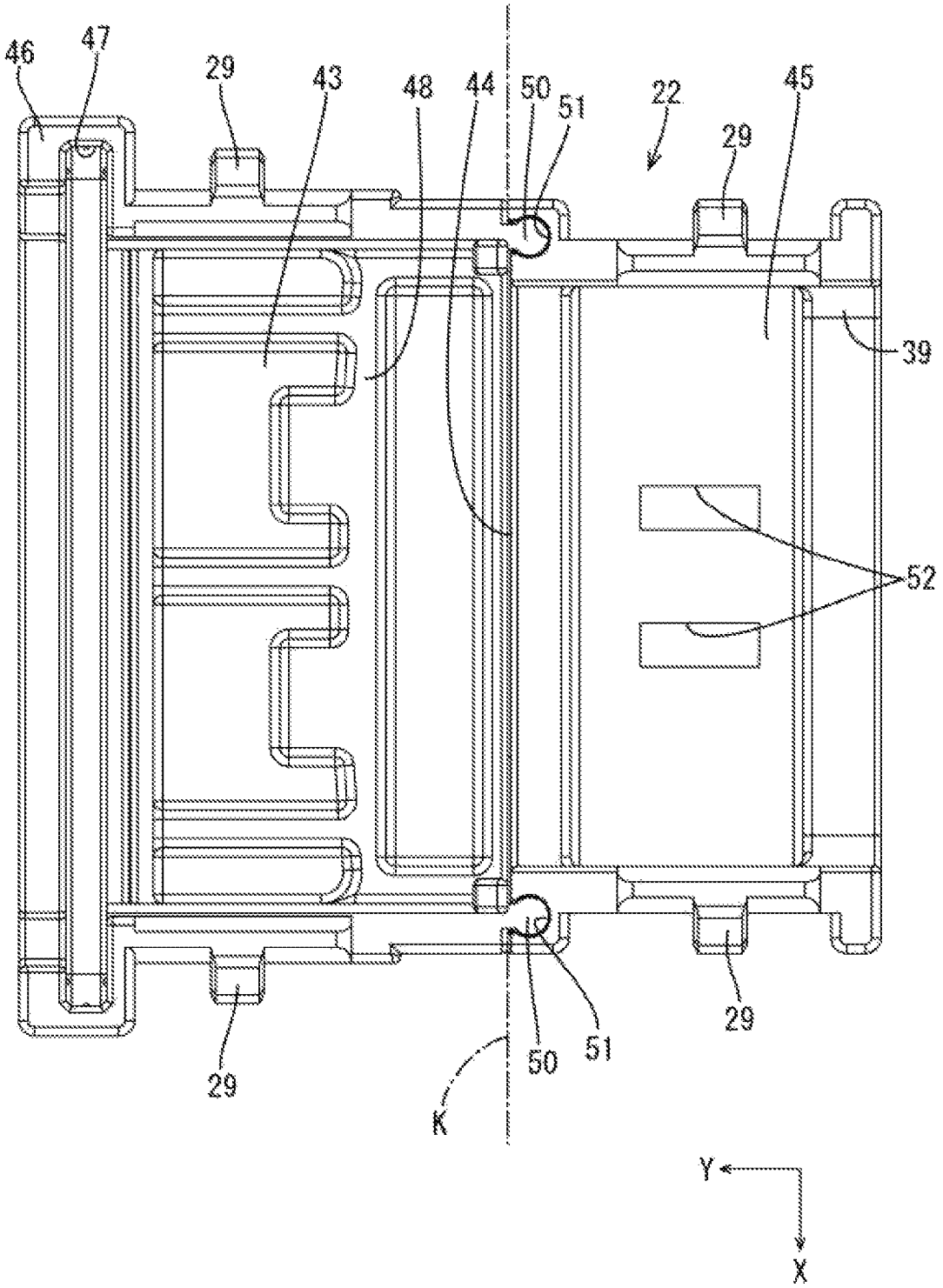
FIG. 14 is a plan view illustrating the second cover in the state where the second engaging part and the second engaged part are engaged.
Figure 15:
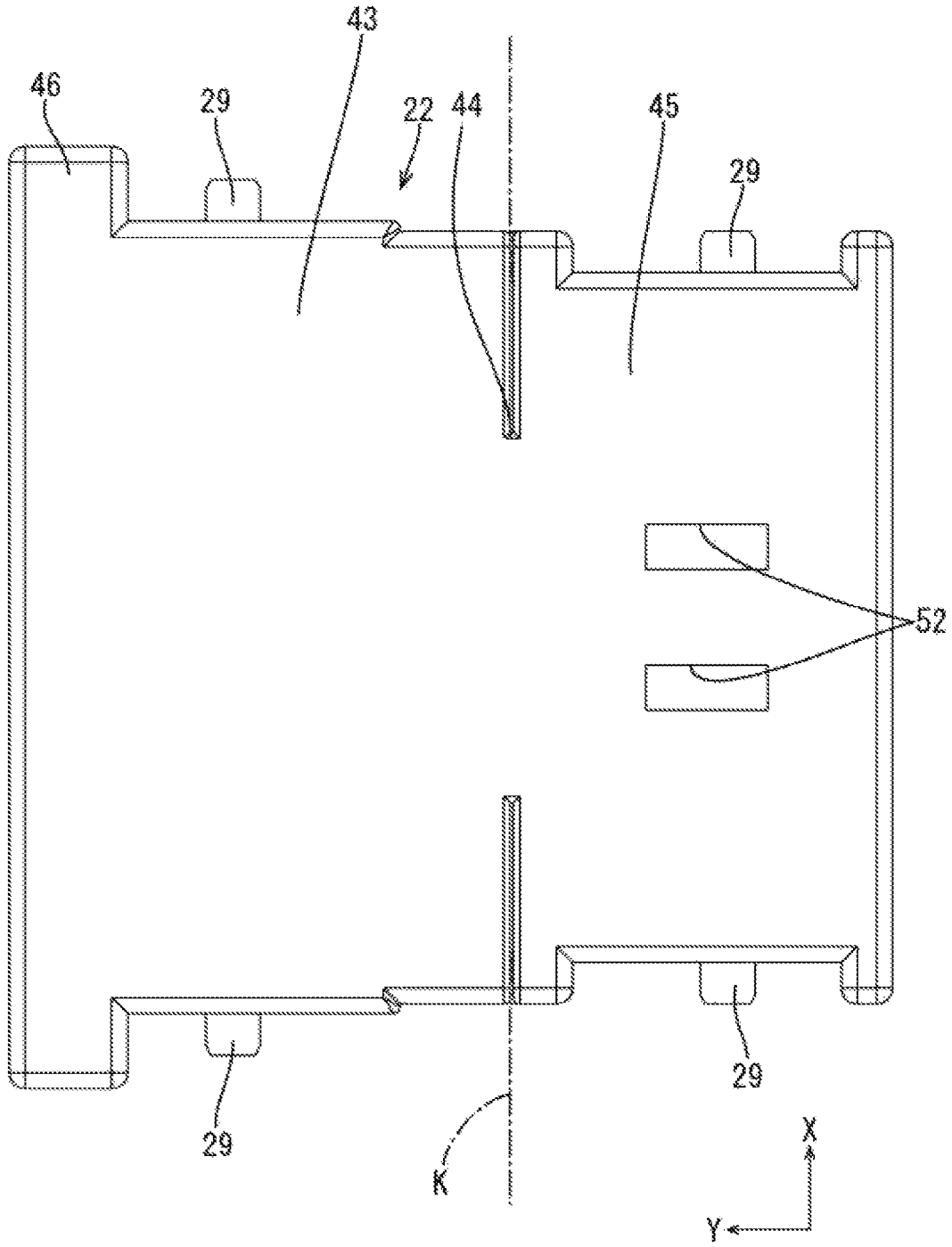
FIG. 15 is a bottom view illustrating the second cover in the state where the second engaging part and the second engaged part are engaged.

As illustrated in FIG. 4, the electric cable cover 13 is formed of insulating synthetic resin. The electric cable cover 13 includes a first cover 21 (one example of split cover), and a second cover 22 (one example of split cover) to be connected with the first cover 21.

First Cover 21

As illustrated in FIG. 5 to FIG. 9, the first cover 21 includes a first base part 23 (one example of base part) to be assembled to, from above, the rear end part of the connector housing 12, a first hinge 24 (one example of hinge) with flexibility that is formed to be integrated with the first base part 23 at a rear end part of the first base part 23, and a first rotation part 25 (one example of rotation part) that is integrally engaged with the first hinge 24 and can rotate using a rotation axis J of the first hinge 24 as a center.

The first base part 23 includes an upper wall, and a pair of side walls that is extended downward from left and right side edges of the upper wall. The first base part 23 has a substantially rectangular shape when viewed from above. At a front end part of the upper wall, a first external fitting part 26 to be externally fitted to the end rib 16 of the connector housing 12 is formed to project upward and frontward. On a lower surface of the first external fitting part 26, a first groove 27 that is externally fitted to the end rib 16 is formed to be depressed upward. The width of the first groove 27 in the front-back direction is the same as or is slightly larger than the width of the end rib 16 in the front-back direction.

On an outer surface of the side wall of the first base part 23, a base part side lock part 28 that forms a gate shape when viewed from a side and that is elastically deformable is provided to project downward. This base part side lock part 28 is elastically hooked with a base part side lock receiving part 29 that is provided to a second cover 22 to be described below.

The first hinge 24 is formed to be extended in the left-right direction. In other words, the first hinge 24 is extended along a direction intersecting with (orthogonal to) a direction where the electric cables 11 are led out from the connector housing 12 (to the back). The first hinge 24 has flexibility. The width of the first hinge 24 in the left-right direction is smaller than the width of the first base part 23 and the first rotation part 25 in the left-right direction. The thickness of the first hinge 24 in the up-down direction is smaller than the thickness of the first base part 23 and the thickness of the first rotation part 25.

Behind the first hinge 24, the first rotation part 25 is formed contiguously to the first hinge 24. The first rotation part 25 has a substantially rectangular shape when viewed from above. The first base part 23, the first hinge 24, and the first rotation part 25 are formed to be integrated. Since the first hinge 24 has flexibility, the first rotation part 25 is rotatable using the rotation axis J as a center. The rotation axis J is extended in the direction intersecting with the direction where the electric cables 11 are led out from the connector housing 12 (to the back) (see FIG. 6 and FIG. 9).

The first rotation part 25 includes an upper wall, a pair of side walls that is extended downward from left and right sides of the upper wall, and a rear wall that is extended downward from a rear end part of the upper wall. The upper wall of the first rotation part 25 includes two tie band insertion holes 34 penetrating the upper wall. The tie band insertion holes 34 are extended in the front-back direction and are arranged with a space therebetween in the left-right direction. Each tie band insertion hole 34 has a rectangular shape that is long and thin in the front-back direction. Through the tie band insertion hole 34, a tie band 35 to be described below can be inserted.

On an outer surface of the side wall of the first rotation part 25, a rotation part side lock part 36 that forms a gate shape when viewed from a side and that is elastically deformable is provided to project downward. This rotation part side lock part 36 is elastically hooked with a rotation part side lock receiving part 37 that is provided to the second cover 22 to be described below.

At a lower edge of a rear wall of the first rotation part 25, a first concave part 38 that is depressed upward is formed. In a state where the first cover 21 and the second cover 22 are connected, the electric cables 11 are led out of the electric cable cover 13 from a space formed between the first concave part 38 and a second concave part 39 provided to the second cover 22.

At the rear end part of the first base part 23, first engaging parts 41 (one example of engaging part) that project to the back from left and right end parts are formed. An end part of the first engaging part 41 has a substantially cylindrical shape that is extended in the up-down direction. At a front end part of the first rotation part 25, a first engaged part 42 (one example of engaged part) is formed on a position corresponding to the first engaging part 41 of the first base part 23. The first engaged part 42 has a groove-like shape that receives an end part of the first base part 23. A cross-sectional shape of the first engaged part 42 is the same as or slightly larger or smaller than a cross-sectional shape of the end part of the first engaging part 41. As the end part of the first engaging part 41 is fitted into the first engaged part 42, the first base part 23 and the first rotation part 25 are prevented from rotating using the rotation axis J of the first hinge 24 as the center (see FIG. 9).

Second Cover 22

As illustrated in FIG. 10 to FIG. 15, the second cover 22 includes: a second base part 43 (one example of base part) that is assembled from below at the rear end part of the connector housing 12; a second hinge 44 (one example of hinge) with flexibility that is formed to be integrated with the second base part 43 at the rear end part of the second base part 43; and a second rotation part 45 (one example of rotation part) that is integrally engaged with the second hinge 44 and can rotate using a rotation axis K of the second hinge 44 as a center.

The second base part 43 includes a lower wall, and a pair of side walls that extends upward from left and right side edges of the lower wall. The second base part 43 has a substantially rectangular shape when viewed from below. The length of the second base part 43 in the front-back direction is larger than the length of the first base part 23 in the front-back direction. At a front end part of the lower wall, a second external fitting part 46 to be externally fitted to the end rib 16 of the connector housing 12 is formed to project downward, left and right sides, and frontward. On a lower surface and left and right inner surfaces of the second external fitting part 46, a second groove 47 that is externally fitted to the end rib 16 is formed to be depressed downward and outward to the left and right sides. The width of the second groove 47 in the front-back direction is the same as or slightly larger than the width of the end rib 16 in the front-back direction.

On a lower surface of the lower wall of the second base part 43, a clamping part 48 is provided at a position slightly front side from the rear end part. The clamping part 48 is extended in the left-right direction and has a rib shape that projects upward. The clamping part 48 is brought into contact with the electric cables 11 from below in a state where the first cover 21 and the second cover 22 are assembled to the connector housing 12. Thus, the electric cables 11 are clamped between the inner wall of the first cover 21 and the clamping part 48.

On an outer surface of each side wall of the second base part 43, the base part side lock receiving part 29 is formed at a position corresponding to the base part side lock part 28 of the first base part 23 in a manner that the base part side lock receiving part 29 projects outward in the left-right direction.

The second hinge 44 is formed to be extended in the left-right direction. In other words, the second hinge 44 is extended along a direction intersecting with (orthogonal to) the direction where the electric cables 11 are led out from the connector housing 12 (to the back). The second hinge 44 has flexibility. The width of the second hinge 44 in the left-right direction is smaller than the width of the second base part 43 and the second rotation part 45 in the left-right direction. The thickness of the second hinge 44 in the up-down direction is smaller than the thickness of the second base part 43 and the thickness of the second rotation part 45.

Behind the second hinge 44, the second rotation part 45 is formed contiguously to the second hinge 44. The second rotation part 45 has a substantially rectangular shape when viewed from above. The second base part 43, the second hinge 44, and the second rotation part 45 are formed to be integrated. Since the second hinge 44 has flexibility, the second rotation part 45 is rotatable using the rotation axis K as the center. The rotation axis K is extended in the direction intersecting with the direction where the electric cables 11 are led out from the connector housing 12 (to the back) (see FIG. 11, FIG. 14, and FIG. 15).

The second rotation part 45 includes a lower wall, a pair of side walls that is extended upward from left and right sides of the lower wall, and a rear wall that extends upward from a rear end part of the lower wall.

On the outer surface of each side wall of the second base part 43, the base part side lock receiving part 29 is formed at a position corresponding to the base part side lock part 28 of the first base part 23 in a manner that the base part side lock receiving part 29 projects outward in the left-right direction.

At a lower edge of a rear wall of the second rotation part 45, a second concave part 39 that is depressed downward is formed. In the state where the first cover 21 and the second cover 22 are coupled, the electric cables 11 are led out from a space formed between the first concave part 38 of the first cover 21 and the second concave part 39 provided to the second cover 22.

At the rear end part of the second base part 43, a second engaging part 50 (one example of engaging part) that projects to the back from the left and right side parts is formed. An end part of the second engaging part 50 has a substantially cylindrical shape that is extended in the up-down direction. At a front end part of the second rotation part 45, a second engaged part 51 (one example of engaged part) is formed on a position corresponding to the second engaging part 50 of the second base part 43. The second engaged part 51 has a groove-like shape that receives an end part of the second base part 43. A cross-sectional shape of the second engaged part 51 is the same as or slightly larger or smaller than a cross-sectional shape of the end part of the second engaging part 50. As the end part of the second engaging part 50 is fitted into the second engaged part 51, the second base part 43 and the second rotation part 45 are prevented from rotating using the rotation axis K of the second hinge 44 as the center (see FIG. 14).

The lower wall of the second rotation part 45 includes two tie band insertion holes 52 penetrating the lower wall. The tie band insertion holes 52 are extended in the front-back direction and are arranged with a space therebetween in the left-right direction. Each tie band insertion hole 52 has a rectangular shape that is long and thin in the front-back direction. Through the tie band insertion hole 52, the tie band 35 to be described below can be inserted.

Figure 19:
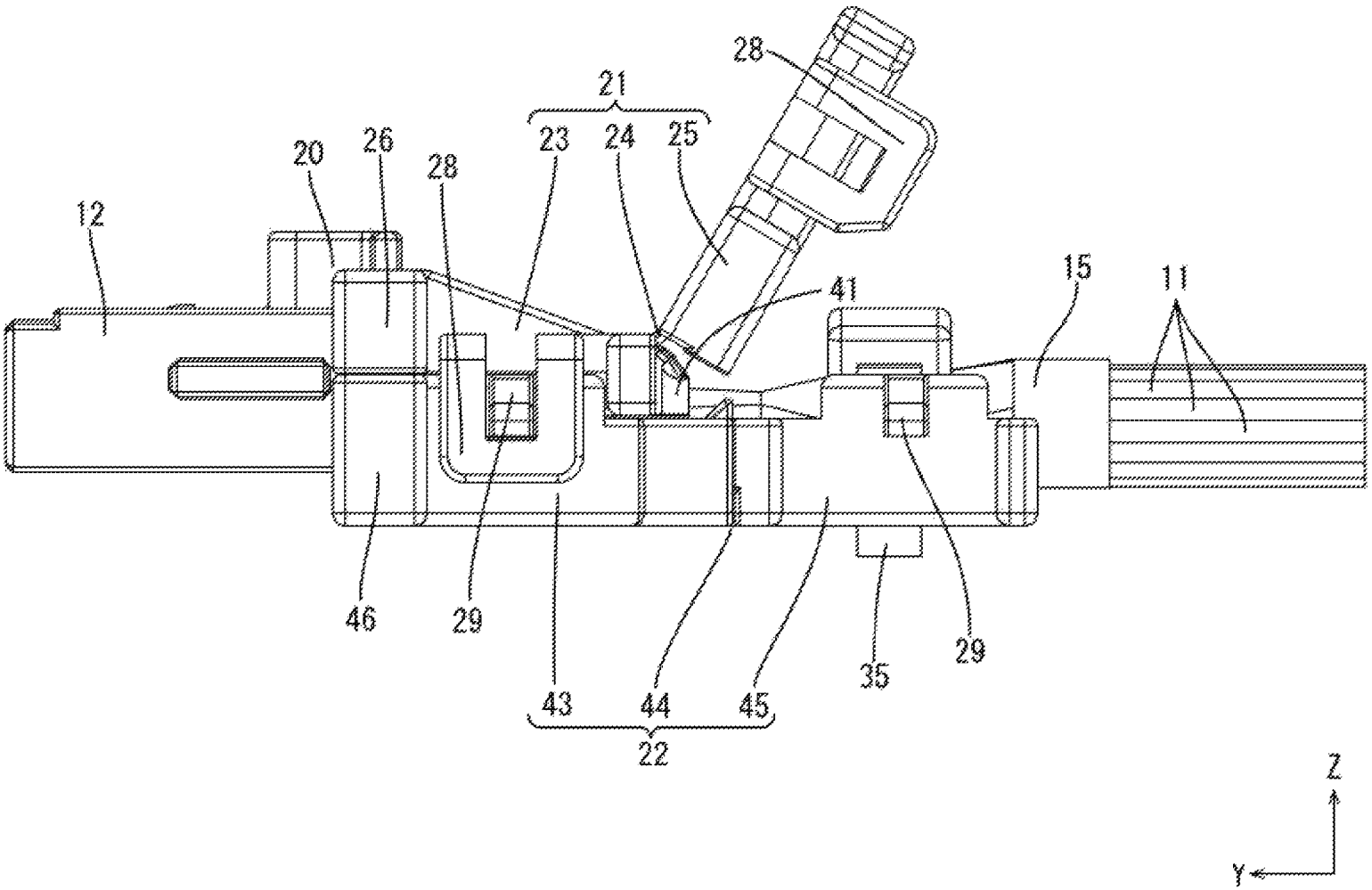
FIG. 19 is a side view illustrating a state where the second rotation part is closed.
Figure 21:
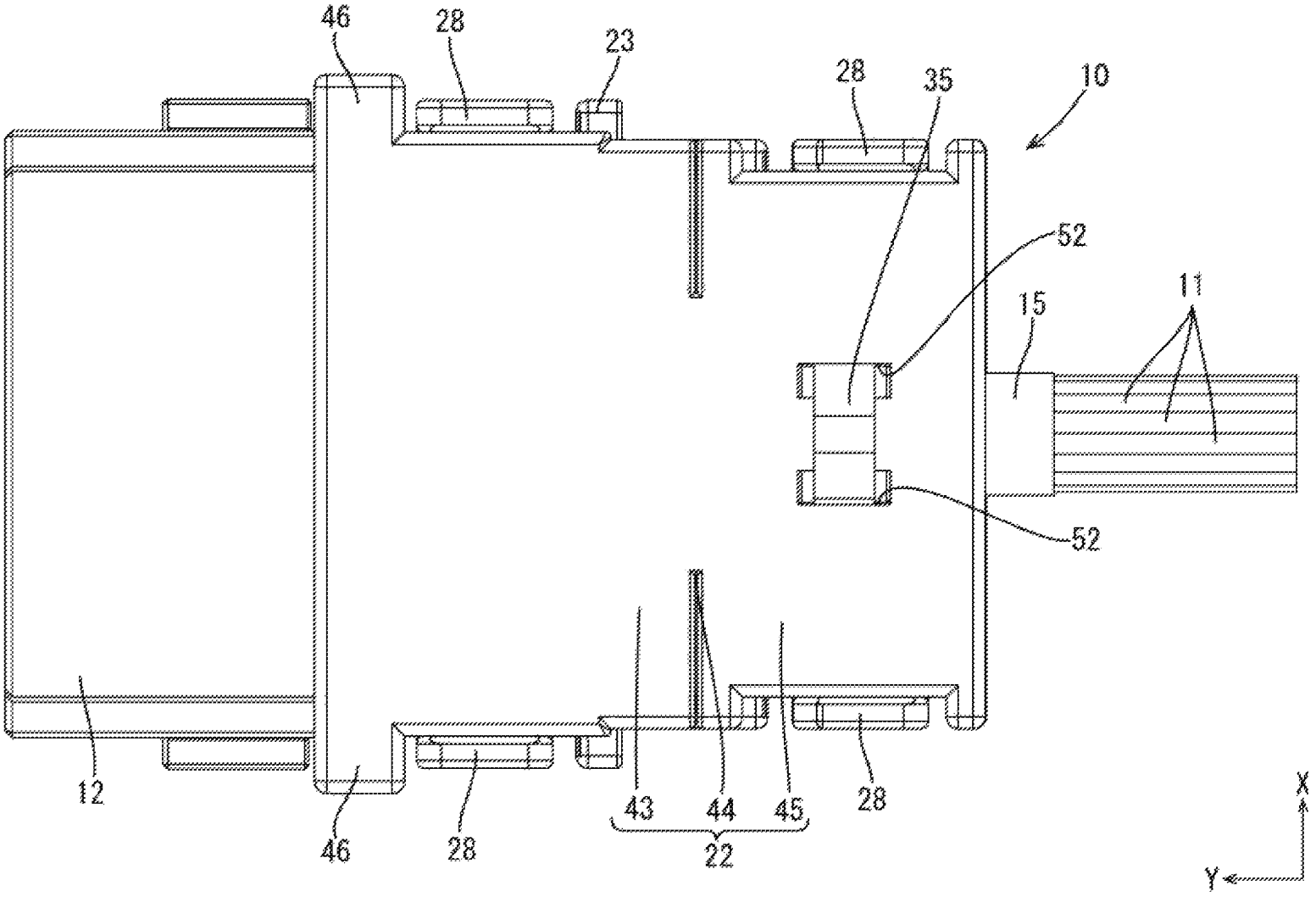
FIG. 21 is a bottom view illustrating the connector.

As illustrated in FIG. 19 and FIG. 21, the electric cables 11 are fastened by the tie band 35, which is known, that is formed of synthetic resin and has a long and thin band-like shape. The tie band 35 is inserted into the tie band insertion hole 52 formed at the lower wall of the second rotation part 45, and in this state, the tie band 35 is wound around an outer periphery of the electric cables 11. Thus, the electric cables 11 are fixed to the lower wall of the second rotation part 45 with the tie band 35.

Figure 20:
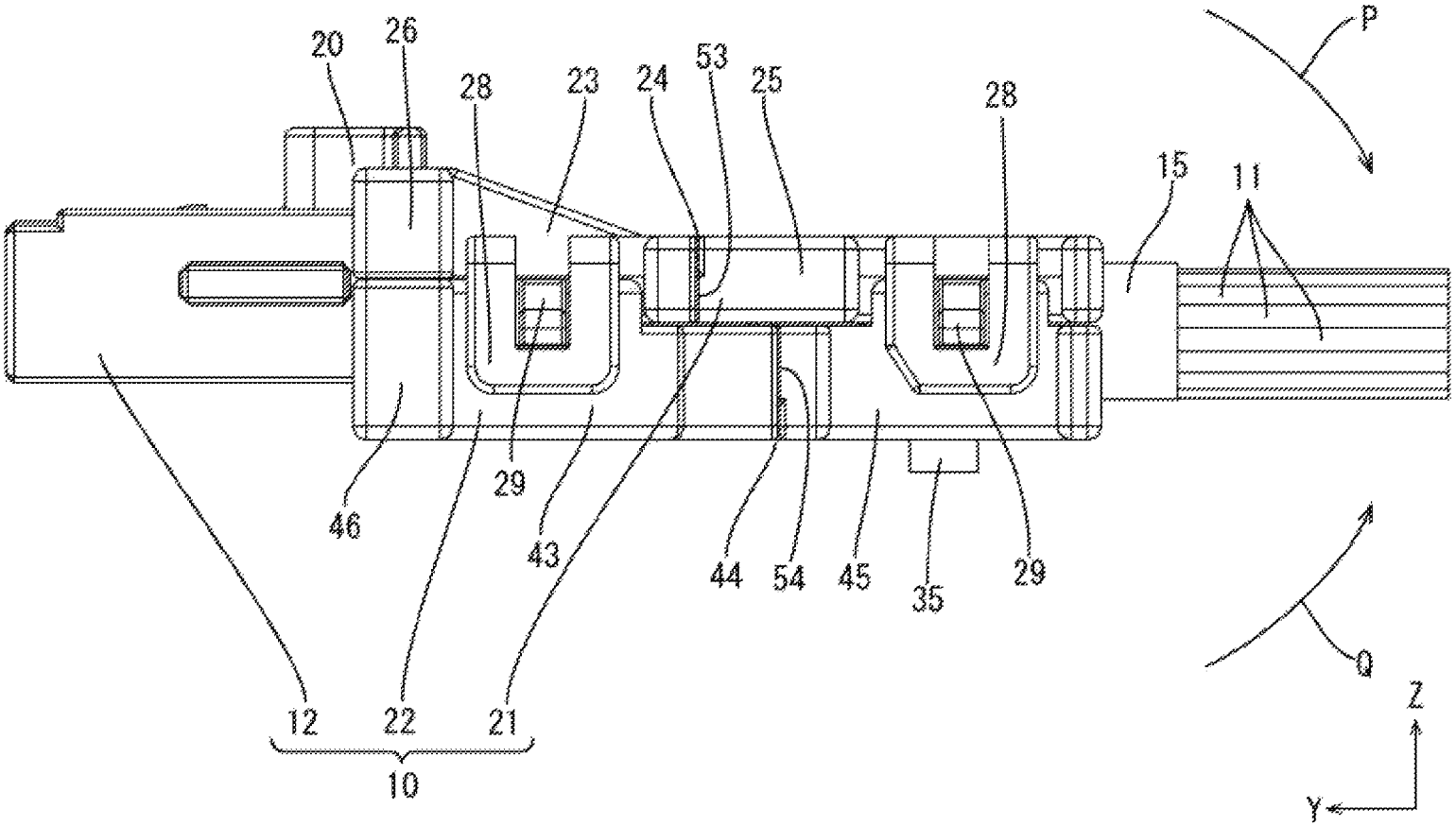
FIG. 20 is a side view illustrating a state where the first rotation part is closed.

In the state where the first cover 21 and the second cover 22 are assembled to the connector housing 12 and the first cover 21 and the second cover 22 are connected to each other as illustrated in FIG. 20, a first border region 53 between the first base part 23 and the first rotation part 25 (one example of border region) and a second border region 54 between the second base part 43 and the second rotation part 45 (another example of border region) are provided at different positions. Specifically, the first border region 53 and the second border region 54 are provided at positions displaced in the direction intersecting with the rotation axis J of the hinge 24 and the rotation axis K of the hinge 44 (to the back in FIG. 20). More specifically, the second border region 54 is behind the first border region 53.

The first border region 53 between the first base part 23 and the first rotation part 25 refers to, if the first base part 23 and the first rotation part 25 are in contact with each other in the state where the first cover 21 and the second cover 22 are assembled together, a region where the first base part 23 and the first rotation part 25 are in contact with each other, and if the first base part 23 and the first rotation part 25 are separated, a region where the first base part 23 and the first rotation part 25 are opposed to each other.

Similarly, the second border region 54 between the second base part 43 and the second rotation part 45 refers to, if the second base part 43 and the second rotation part 45 are in contact with each other in the state where the first cover 21 and the second cover 22 are assembled together, a region where the second base part 43 and the second rotation part 45 are in contact with each other, and if the second base part 43 and the second rotation part 45 are separated, a region where the second base part 43 and the second rotation part 45 are opposed to each other.

At a position below the first border region 53, the second base part 43 of the second cover 22 is disposed. Above the second border region 54, the first rotation part 25 of the first cover 21 is disposed.

The first hinge 24 and the second hinge 44 are provided at different positions. Specifically, the first hinge 24 and the second hinge 44 are provided at positions displaced in regard to the direction intersecting with the rotation axis J of the hinge 24 and the rotation axis K of the hinge 44 (to the back in FIG. 20). Specifically, the second hinge is positioned behind the first hinge 24.

Process of Producing Connector 10

Subsequently, one example of a process of producing the connector 10 will be described. The process of producing the connector 10 is not limited by the description below.

The terminal connected to the end of the electric cable 11 is inserted into the cavity 14 from the back of the connector housing 12. In a state where the terminal is housed inside the connector housing 12, the electric cables 11 are led out from the rear end part of the connector housing 12 to the back.

Figure 16:
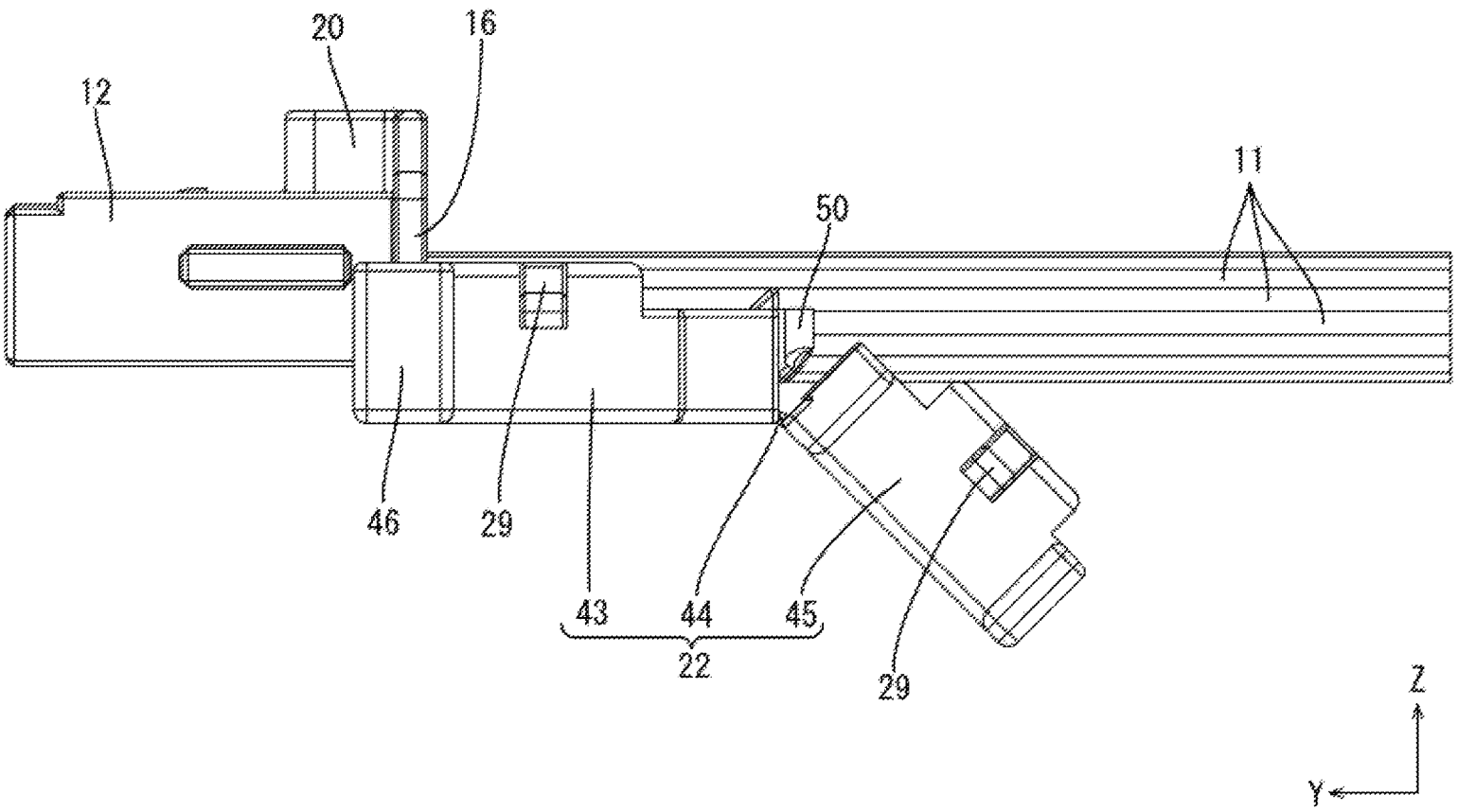
FIG. 16 is a side view illustrating a state where the second cover is attached to a connector from which electric cables are led out.

As illustrated in FIG. 16, the second cover 22 is assembled to the rear end part of the connector housing 12 from below. To the end rib 16 of the connector housing 12, the second groove 47 provided at the second external fitting part 46 of the second cover 22 is brought close from below, and the lower part of the end rib 16 is fitted into this second groove 47.

Figure 17:
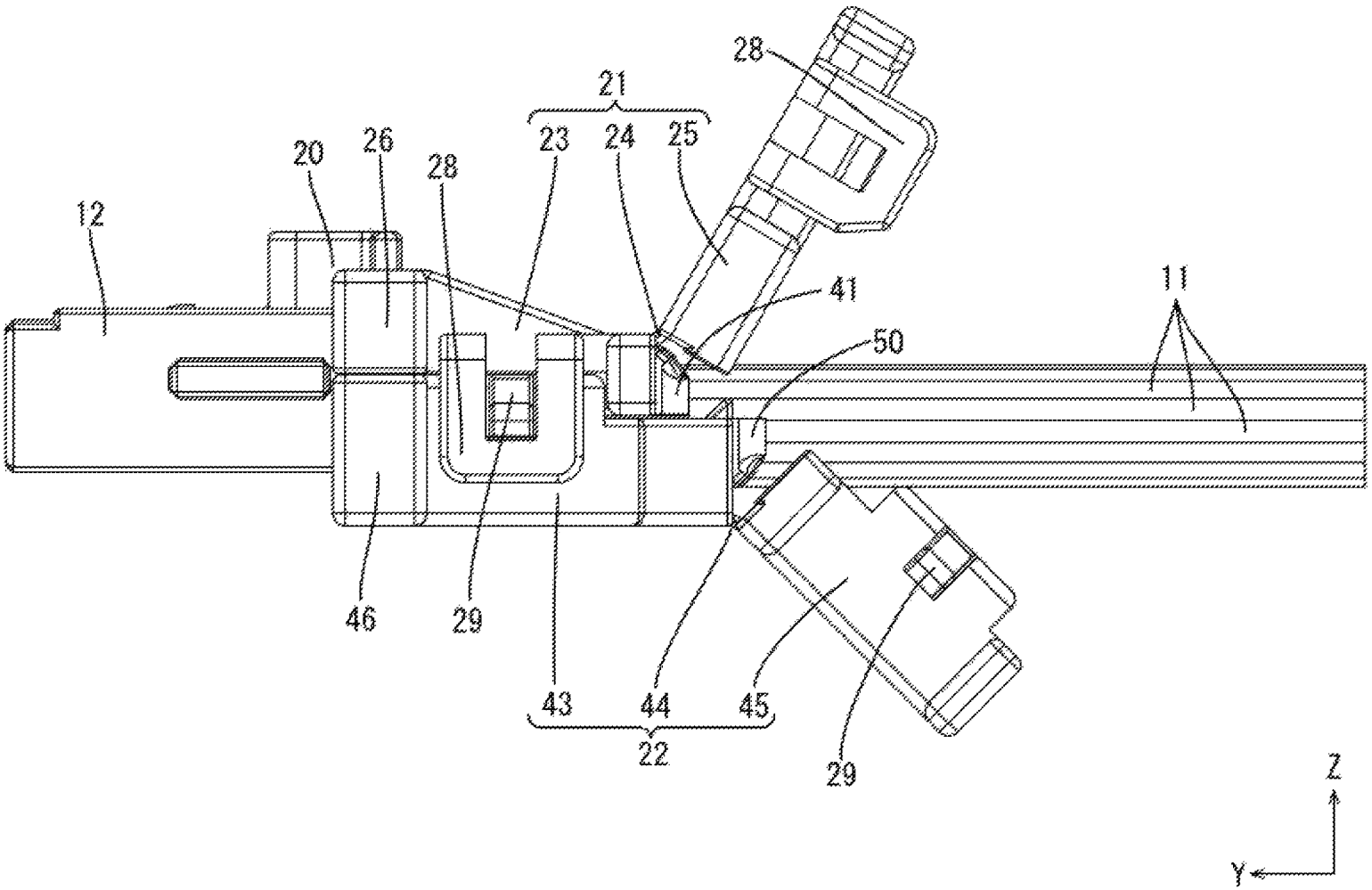
FIG. 17 is a side view illustrating a state where the second cover and the first cover are attached to the connector from which the electric cables are led out.

As illustrated in FIG. 17, the first cover 21 is assembled to the rear end part of the connector housing 12 from above. To the end rib 16 of the connector housing 12, the first groove 27 provided to the first external fitting part 26 of the first cover 21 is brought close from above, and the upper part of the end rib 16 is fitted into this first groove 27.

By attaching the first base part 23 of the first cover 21 and the second base part 43 of the second cover 22 to the rear end part of the connector housing 12, the base part side lock part 28 of the first cover 21 is elastically engaged with the base part side lock receiving part 29 of the second cover 22. Thus, the first base part 23 and the second base part 43 are attached to the rear end part of the connector housing 12 in the state where the separation between the first base part 23 and the second base part 43 in the up-down direction is restricted.

In the state where the first base part 23 and the second base part 43 are attached to the rear end part of the connector housing 12, the connector housing 12 is clamped by the first external fitting part 26 of the first base part 23 and the second external fitting part 46 of the second base part 43. When the end rib 16 of the connector housing 12 is fitted into the first groove 27 of the first base part 23 and the second groove 47 of the second base part 43, the first base part 23 and the second base part 43 are held in a manner that the first base part 23 and the second base part 43 will not fall off from the connector housing 12.

The first rotation part 25 is rotated counterclockwise in FIG. 17 using the rotation axis J of the first hinge 24 as the center. In addition, the second rotation part 45 is rotated clockwise in FIG. 17 using the rotation axis K of the second hinge 44 as the center. Thus, the work space is formed for bundling the electric cables 11 easily.

Figure 18:
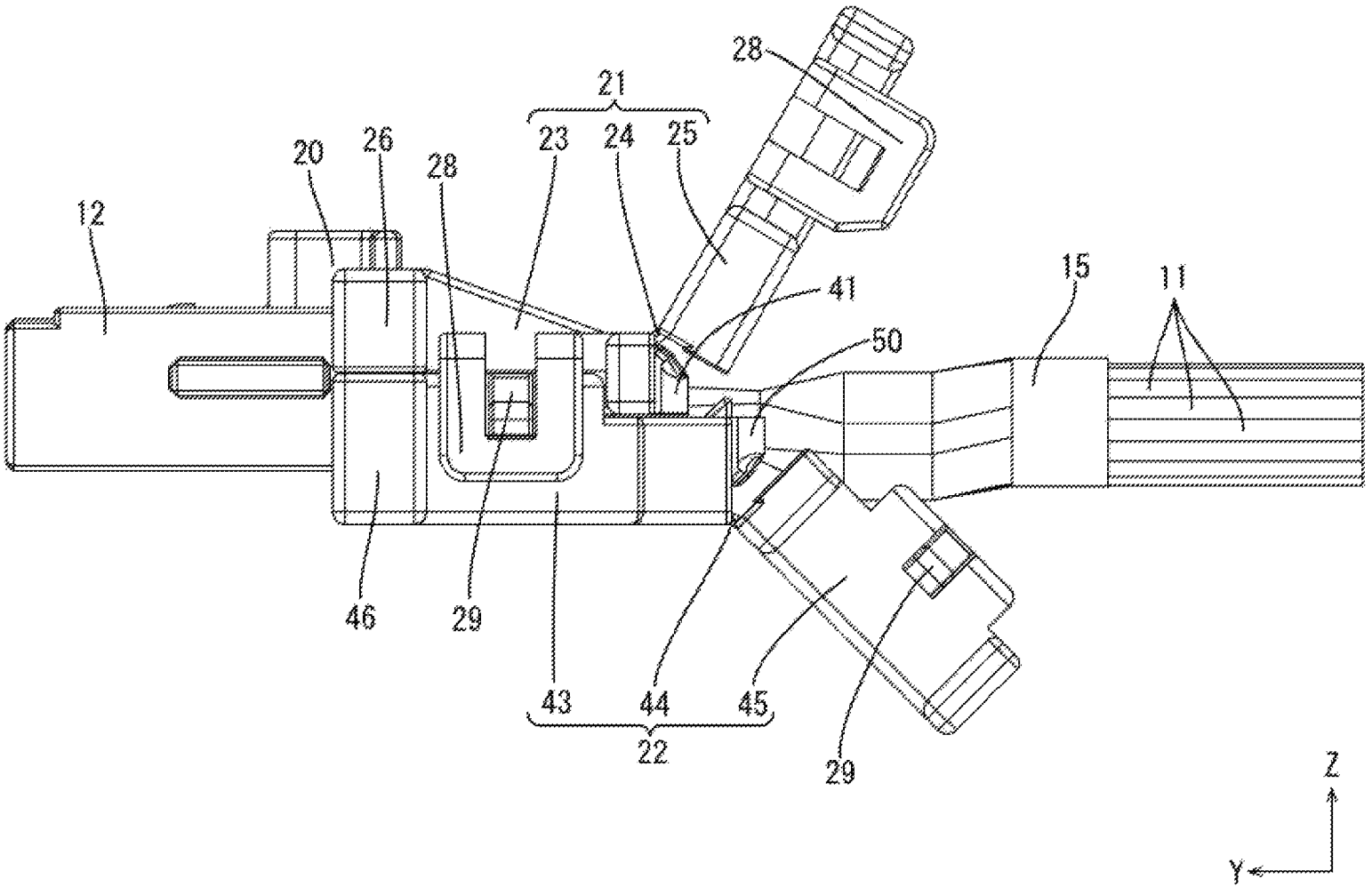
FIG. 18 is a side view illustrating a state where a tape is wound around an outer periphery of the electric cables.

As illustrated in FIG. 18, the tape 15 is wound around the outer periphery of the electric cables 11 led out of the connector housing 12; thus, the electric cables 11 are bundled.

Using the rotation axis K of the second hinge 44 as a center, the second rotation part 45 is rotated counterclockwise in FIG. 18, and thus, the second engaging part 50 of the second base part 43 and the second engaged part 51 of the second rotation part 45 are engaged.

As illustrated in FIG. 19, the tie band 35 is wound around the outer periphery of the electric cables 11 bundled by the tape 15 while the tie band 35 is inserted into the tie band insertion hole 52 of the second rotation part 45. Thus, the electric cables 11 are fixed to the second rotation part 45.

Using the rotation axis J of the first hinge 24 as the center, the first rotation part 25 is rotated clockwise in FIG. 19. Then, the rotation part side lock part 36 of the first rotation part 25 and the rotation part side lock receiving part 37 of the second rotation part 45 are hooked with each other; thus, the first rotation part 25 and the second rotation part 45 are connected with each other. In addition, the first engaging part 41 of the first base part 23 and the first engaged part 42 of the first rotation part 25 are engaged with each other (see FIG. 20).

In the state where the first rotation part 25 and the second rotation part 45 are assembled to each other, the electric cables 11 are led out to the back from the space between the first concave part 38 of the first rotation part 25 and the second concave part 39 of the second rotation part 45. Thus, the connector 10 is completed.

Operation Effect of the Present Embodiment

Subsequently, an operation effect of the present embodiment will be described. The electric cable cover 13 according to the present embodiment is the electric cable cover 13 that is to be mounted on a connector housing 12 and that covers the electric cables 11 led out from the connector housing 12. The electric cable cover 13 includes the first cover 21 and the second cover 22 that are connectable to each other. Each of the first cover 21 and the second cover 22 includes: the first base part 23 and the second base part 43 that are to be attached to the connector housing 12; the first hinge 24 and the second hinge 44 with flexibility that are formed to be integrated with the base parts 23 and 43; and the first rotation part 25 and the second rotation part 45 that are contiguous to the hinges 24 and 44 and rotate using the rotation axes J and K of the hinges 24 and 44 as the center. In the state where the first cover 21 and the second cover 22 are connected to each other, the first border region 53 between the first base part 23 and the first rotation part 25 in the first cover 21 and the second border region 54 between the second base part 43 and the second rotation part 45 in the second cover 22 are provided at different positions.

The connector 10 according to the present embodiment includes the electric cable cover 13, and the connector housing 12 on which the electric cable cover 13 is mounted.

By the above configuration, even in the case where a force in the direction of rotating the rotation part is applied to the rotation part of one of the first cover 21 and the second cover 22 that are connected to each other, the force can be received by the base part and the rotation part of the other cover. Thus, the rotation part that has received the force rotates less easily with the other rotation part that is connected. As a result, the deformation of the electric cable cover 13 as a whole can be suppressed and accordingly, the strength of the electric cable cover 13 can be improved.

For example, in a case where a downward external force is applied to the electric cables 11, the downward force is also applied to the electric cable cover 13 through the electric cables 11. Then, the first rotation part 25 will rotate in a direction indicated by an arrow P in FIG. 20 using the rotation axis J of the first hinge 24 of the first cover 21 as the center.

As described above, the first border region 53 and the second border region 54 are provided at the different positions. Thus, at the position below the first border region 53, the second base part 43 of the second cover 22 is disposed and above the second border region 54, the first rotation part 25 of the first cover 21 is disposed. Accordingly, the rotation of the first rotation part 25 in the direction indicated by the arrow P in FIG. 20 can be suppressed because the first rotation part 25 is supported by the second base part 43 of the second cover 22. Accordingly, the excessive deformation of the electric cable cover 13 can be suppressed and the strength of the electric cable cover 13 can be improved.

On the other hand, also when an upward external force is applied to the electric cables 11, the rotation of the second rotation part 45 in a direction indicated by an arrow Q in FIG. 20 using the rotation axis K of the second hinge 44 as the center can be suppressed because the second rotation part 45 is supported by the first rotation part 25 of the first cover 21. Accordingly, the excessive deformation of the electric cable cover 13 can be suppressed and the strength of the electric cable cover 13 can be improved.

According to the present embodiment, the first border region 53 and the second border region 54 are provided at the positions displaced in regard to the direction intersecting with the rotation axis J of the hinge 24 and the rotation axis K of the hinge 44 (to the back in FIG. 20).

In the above configuration, in the state where the first cover 21 and the second cover 22 are connected to each other, the first border region 53 in the first cover 21 and the second border region 54 in the second cover 22 are disposed at the different positions for sure. Thus, in the case where the force in the direction of rotating the rotation part is applied to the rotation part of one cover, the rotation of the rotation part that has received the force can be suppressed for sure by the base part or rotation part of the other cover provided to be displaced in the direction intersecting with the rotation axis of the rotation part. Specifically, the first rotation part 25 is supported by the second base part 43 of the second cover 22, and the second rotation part 45 is supported by the first rotation part 25 of the first cover 21.

In the present embodiment, in the state where the first cover 21 and the second cover 22 are connected to each other, the first hinge 24 of the first cover 21 and the second hinge 44 of the second cover 22 are provided at the different positions.

In the above configuration, the rotation axis J of the first hinge 24 of the first cover 21 and the rotation axis K of the second hinge 44 of the second cover 22 are disposed at the different positions. Therefore, even in the case where the force in the direction of rotating the rotation part is applied to one rotation part, the rotation of the rotation part that has received the force along the same trajectory as the other rotation part can be suppressed. As a result, the deformation of the electric cable cover 13 as a whole can be suppressed and accordingly, the strength of the electric cable cover 13 can be improved.

In the present embodiment, the first hinge 24 and the second hinge 44 are provided at the positions displaced in regard to the direction intersecting with the rotation axis J of the hinge 24 and the rotation axis K of the hinge 44.

In the above configuration, in the state where the first cover 21 and the second cover 22 are connected to each other, the rotation axis J of the first rotation part 25 and the rotation axis K of the second rotation part 45 are displaced in the front-back direction. Thus, in the case where the force in the rotating direction is applied to the first rotation part 25 or the second rotation part 45, the rotation of the rotation part that has received the force can be suppressed for sure by the base part or the rotation part that has not received the force. Specifically, the first rotation part 25 is supported by the second base part 43 of the second cover 22 and the second rotation part 45 is supported by the first rotation part 25 of the first cover 21. As a result, the deformation of the electric cable cover 13 as a whole can be suppressed and accordingly, the strength of the electric cable cover 13 can be improved.

In the present embodiment, the first base part 23 includes the first engaging part 41, and the first rotation part 25 includes the first engaged part 42 that is engaged with the first engaging part 41. The second base part 43 includes the second engaging part 50, and the second rotation part 45 includes the second engaged part 51 that is engaged with the second engaging part 50.

By the above configuration, the first base part 23 and the first rotation part 25 are firmly connectable to each other through the engagement between the first engaging part 41 and the first engaged part 42. Therefore, the strength of the electric cable cover 13 can be improved further.

Similarly, the second base part 43 and the second rotation part 45 are firmly connectable to each other through the engagement between the second engaging part 50 and the second engaged part 51. Therefore, the strength of the electric cable cover 13 can be improved further.

Even if the first hinge 24 is broken, the first base part 23 and the first rotation part 25 can remain integrally assembled by the engaged structure between the first engaging part 41 and the first engaged part 42. Therefore, the function of protecting the electric cables 11 with the electric cable cover 13 can be maintained.

Similarly, even if the second hinge 44 is broken, the second base part 43 and the second rotation part 45 can remain integrally assembled by the engaged structure between the second engaging part 50 and the second engaged part 51. Therefore, the function of protecting the electric cables 11 with the electric cable cover 13 can be maintained.

In the present embodiment, the second cover 22 includes the clamping part 48. The clamping part 48 is brought into contact with the electric cables 11 from below in the state where the first cover 21 and the second cover 22 are connected to each other. The electric cables 11 are clamped by the first cover 21 and the clamping part 48.

In the above configuration, the electric cables 11 are clamped by the first cover 21 and the clamping part 48 in the state where the first cover 21 and the second cover 22 are connected to each other. Thus, even when the external force is applied to the electric cables 11, the clamping part 48 can receive this external force and accordingly, the strength of the electric cable cover 13 can be improved further.

Second Embodiment

Figure 22:
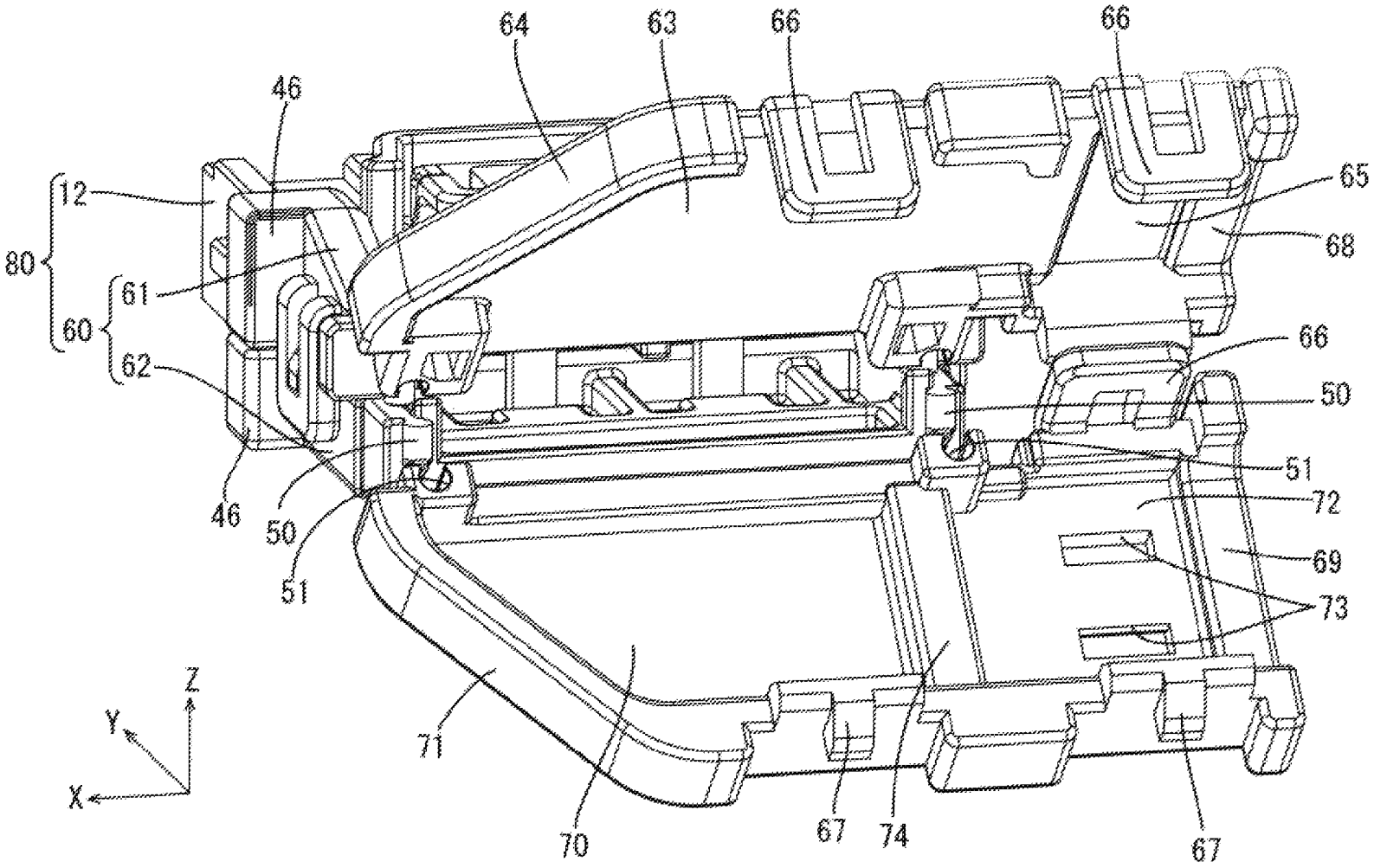
FIG. 22 is a perspective view illustrating a state where a first cover and a second cover are attached to a connector housing according to a second embodiment.
Figure 23:
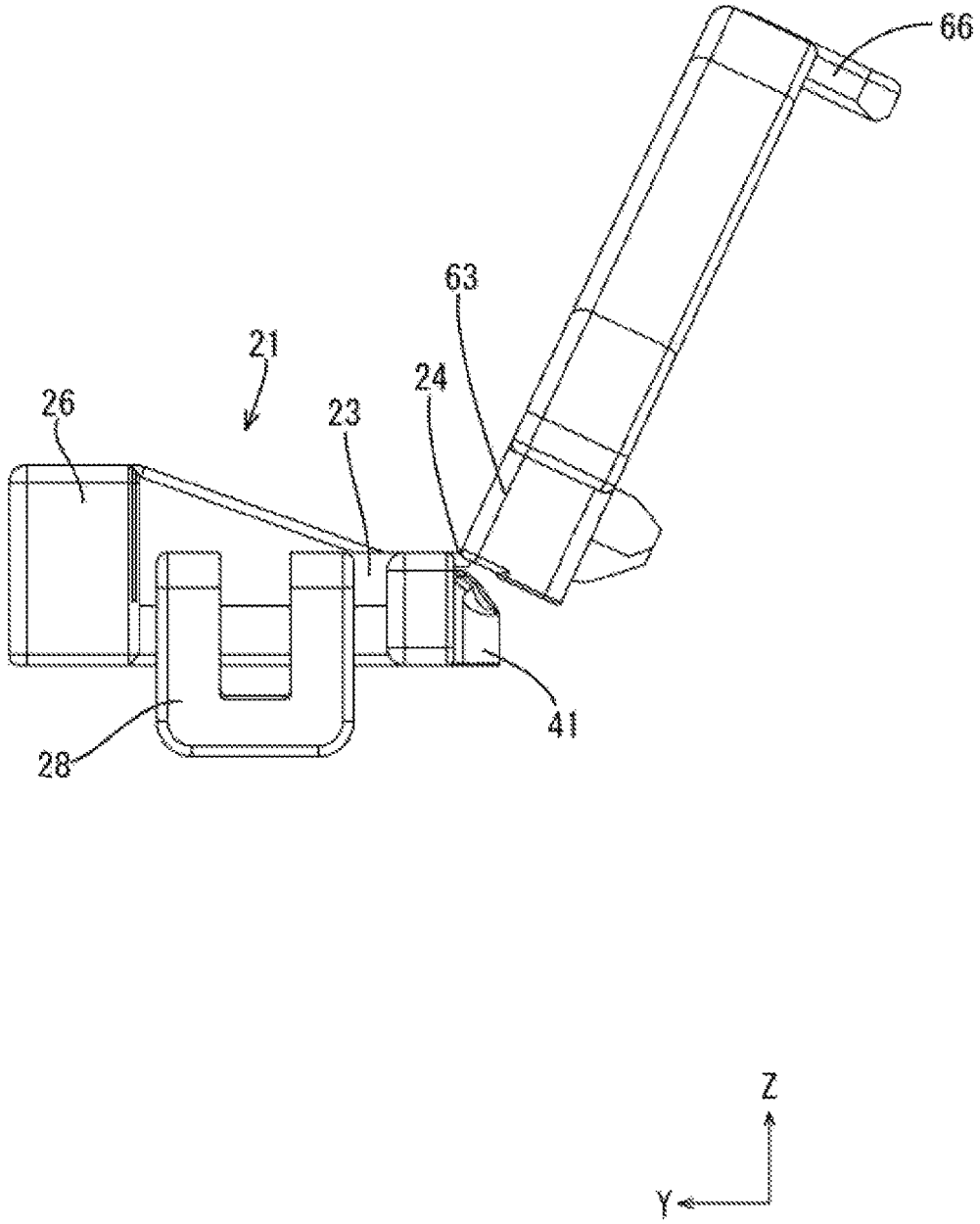
FIG. 23 is a side view illustrating the first cover in the state where a first rotation part is rotated.
Figure 24:
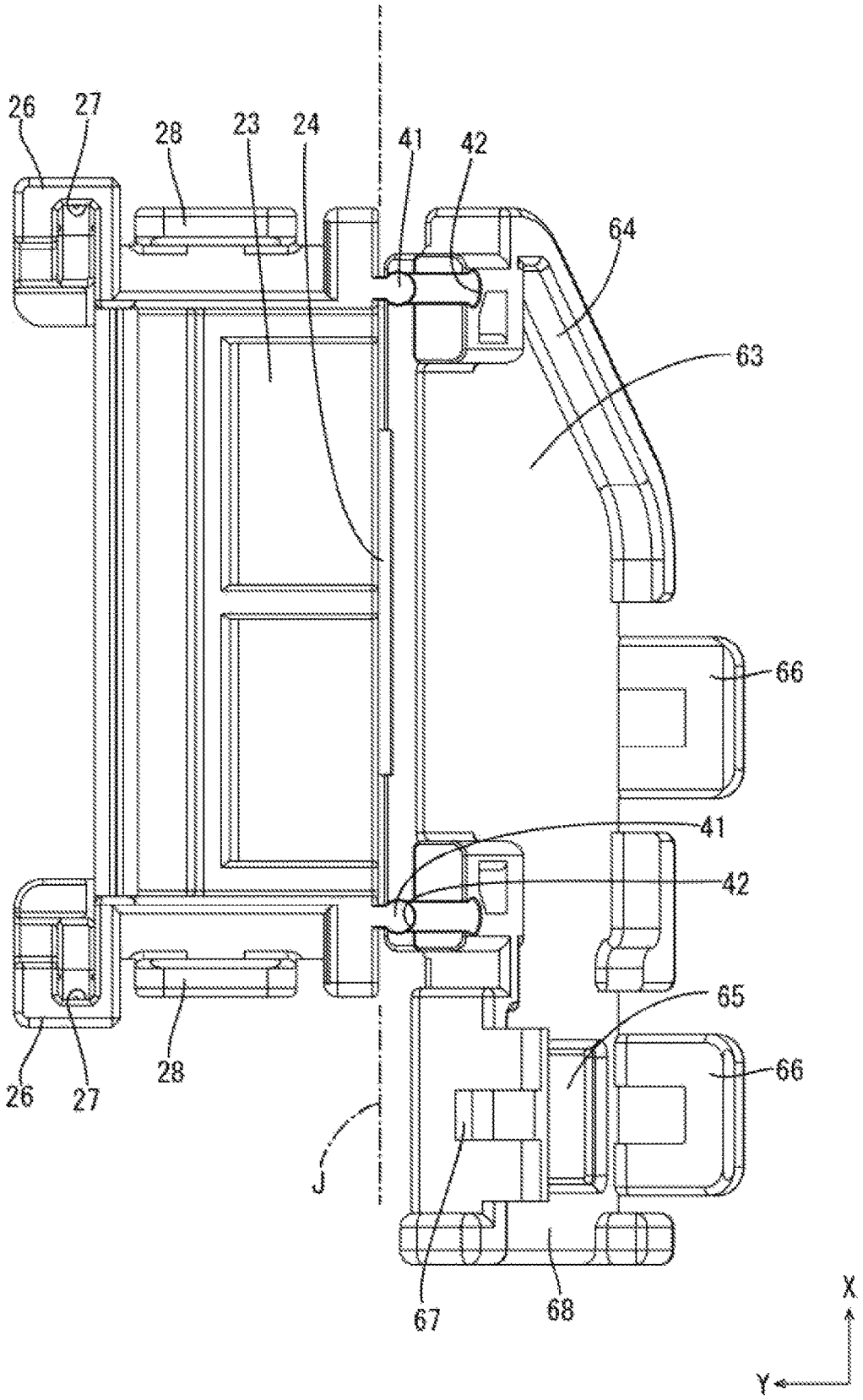
FIG. 24 is a bottom view illustrating the first cover in the state where the first rotation part is rotated.
Figure 25:
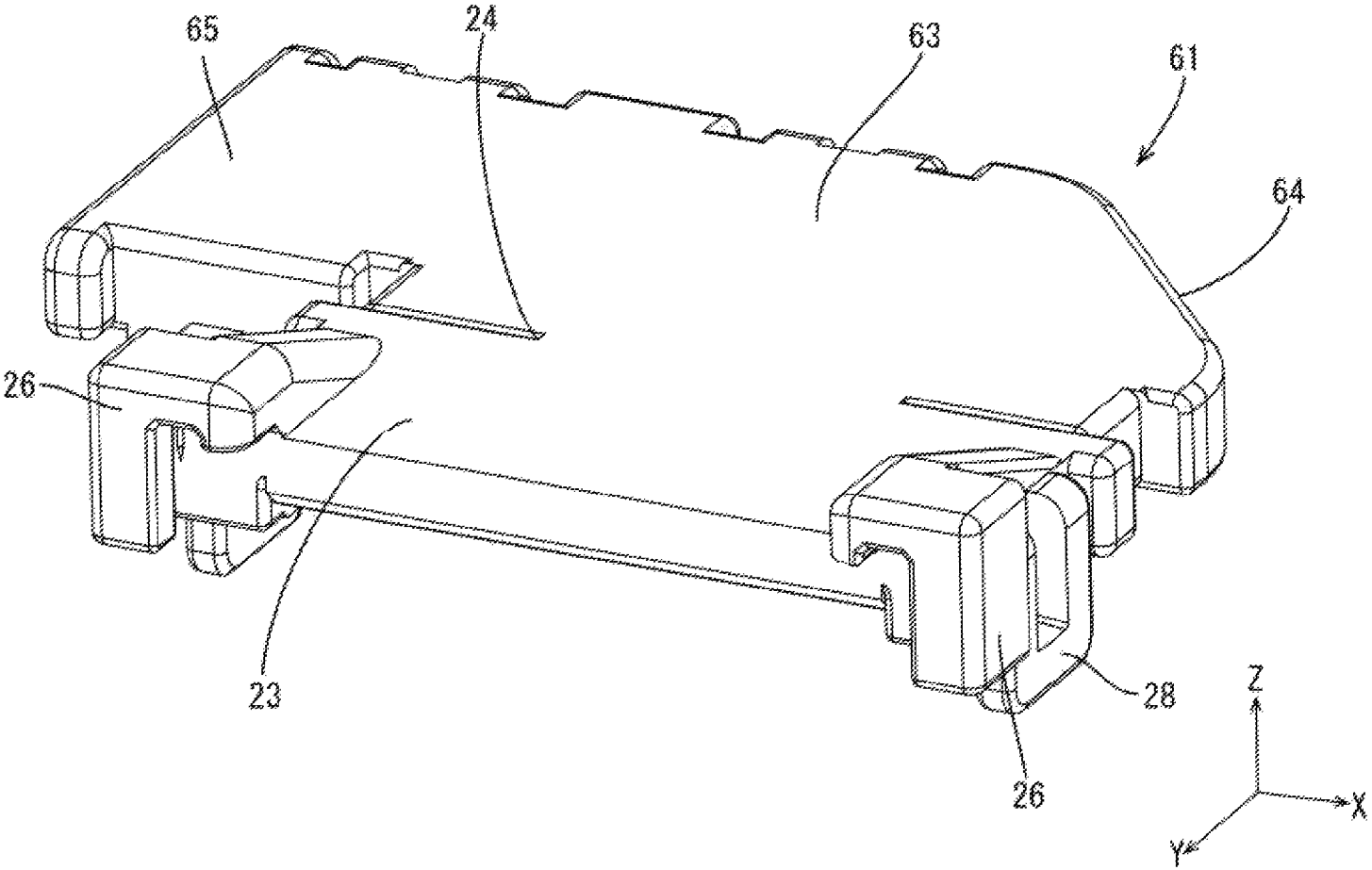
FIG. 25 is a perspective view illustrating the first cover in the state where a first engaging part and a first engaged part are engaged.
Figure 26:
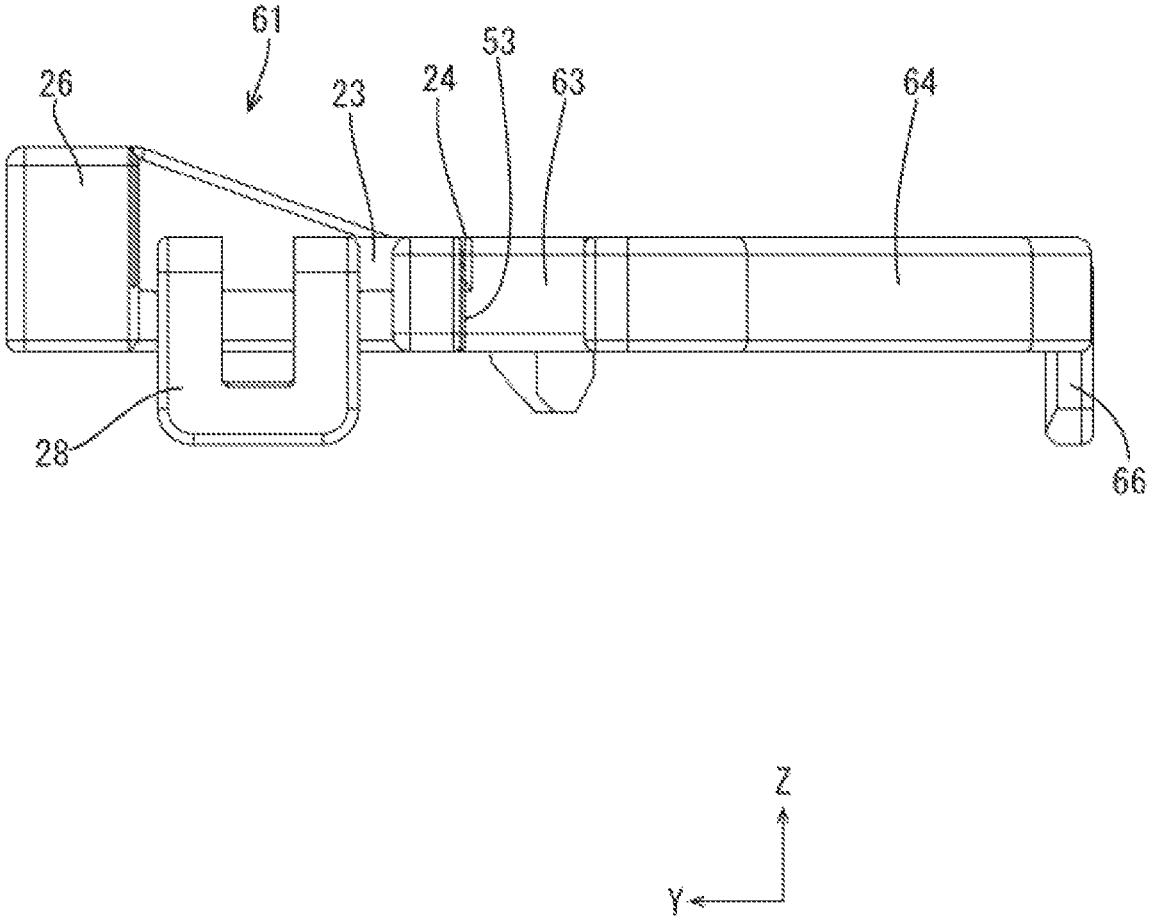
FIG. 26 is a side view illustrating the first cover in the state where the first engaging part and the first engaged part are engaged.
Figure 27:
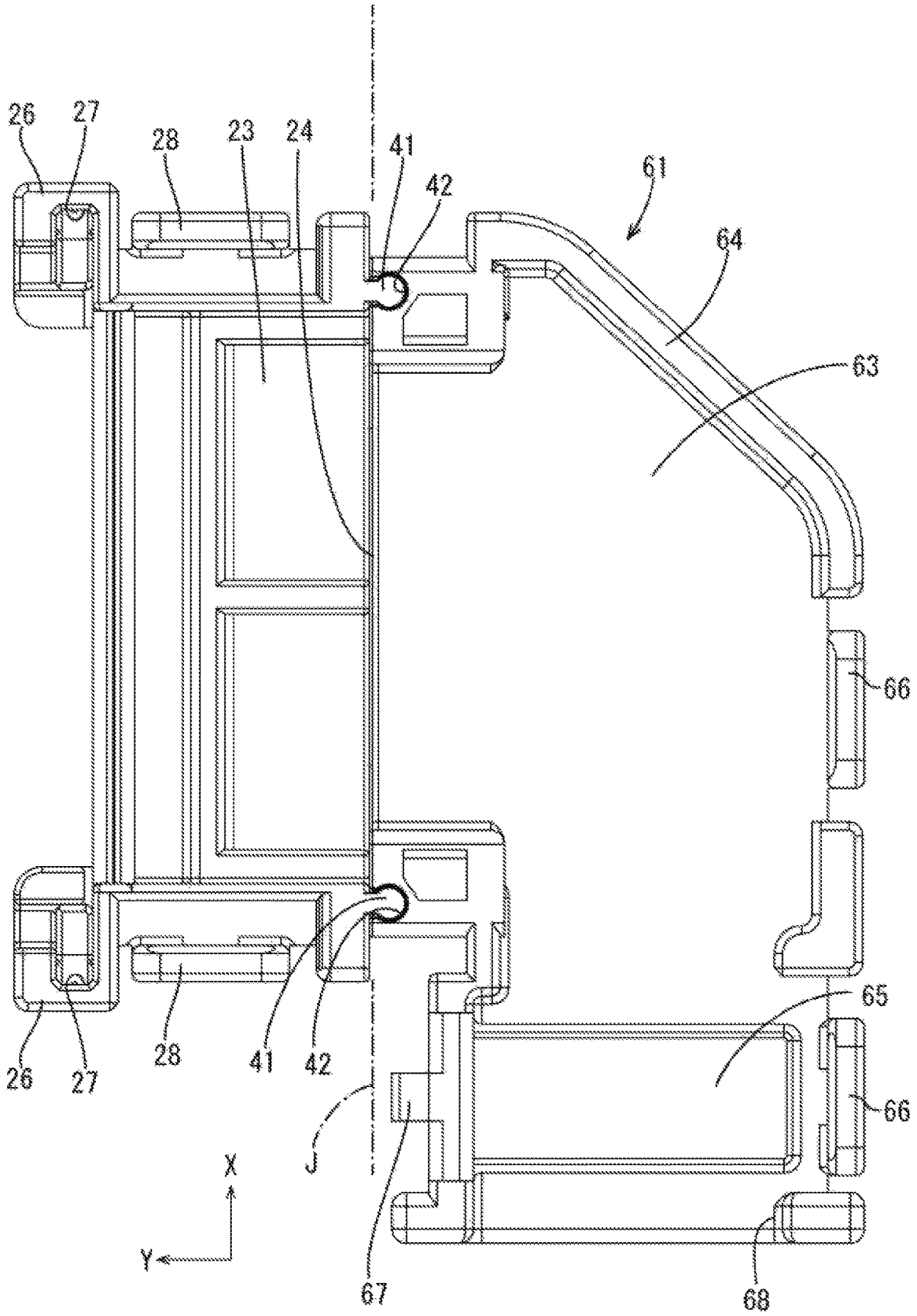
FIG. 27 is a bottom view illustrating the first cover in the state where the first engaging part and the first engaged part are engaged.
Figure 28:
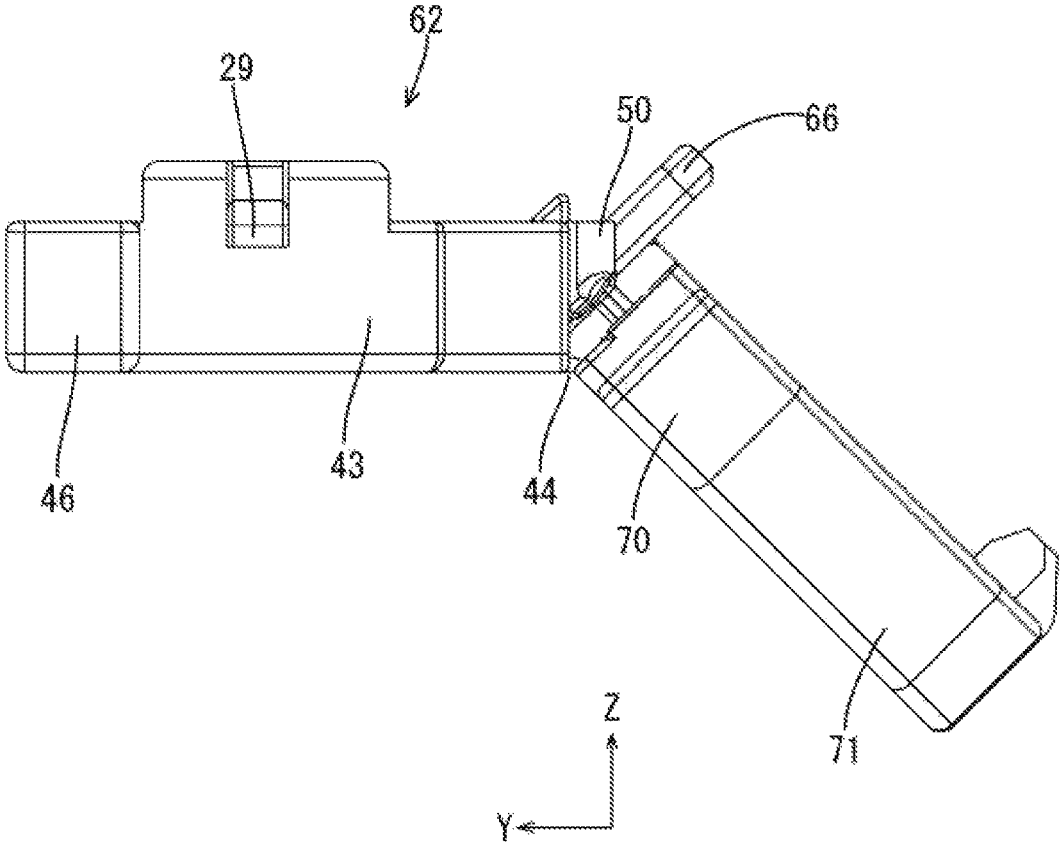
FIG. 28 is a side view illustrating the second cover in the state where a second rotation part is rotated.
Figure 29:
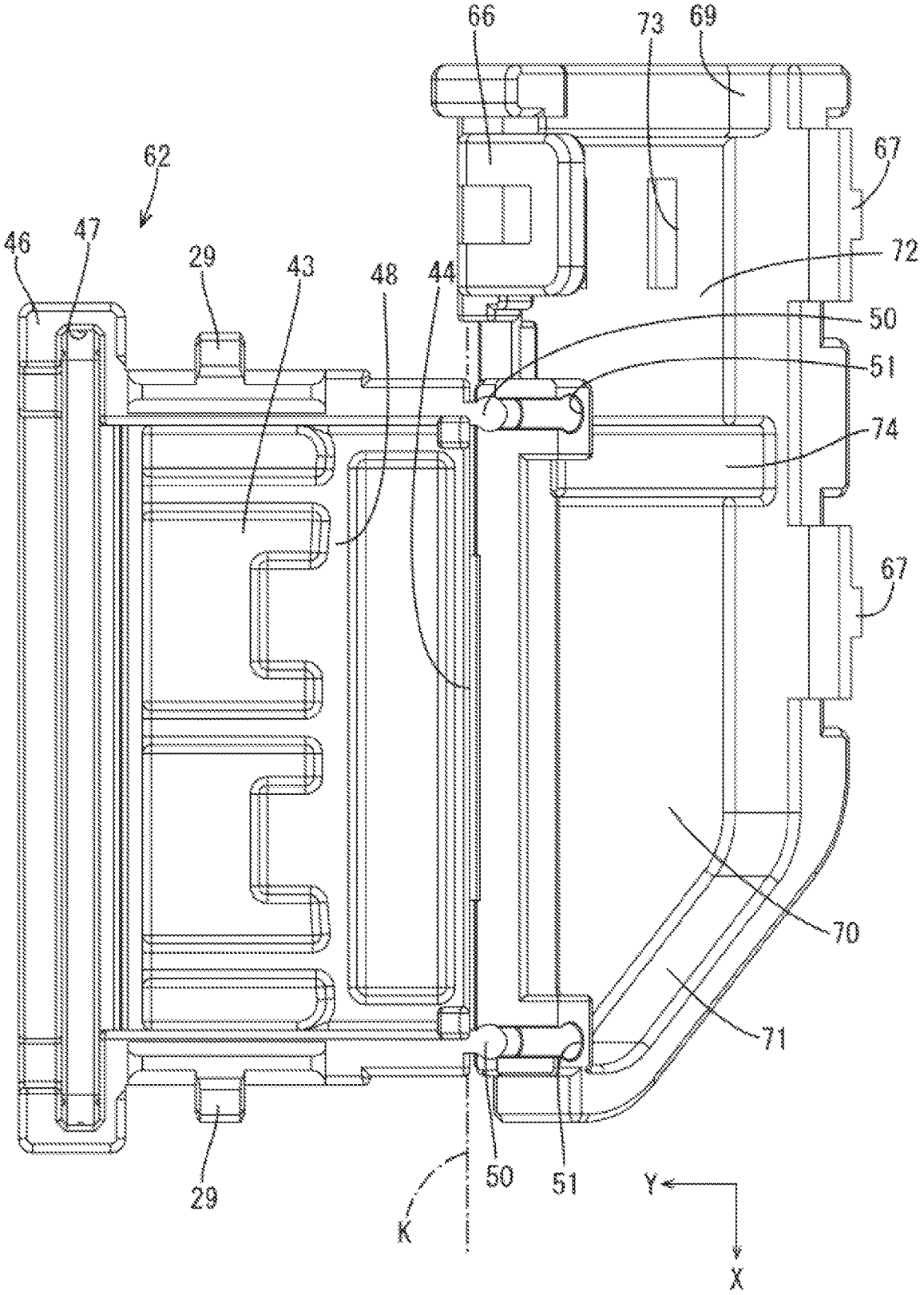
FIG. 29 is a plan view illustrating the second cover in the state where the second rotation part is rotated.
Figure 30:
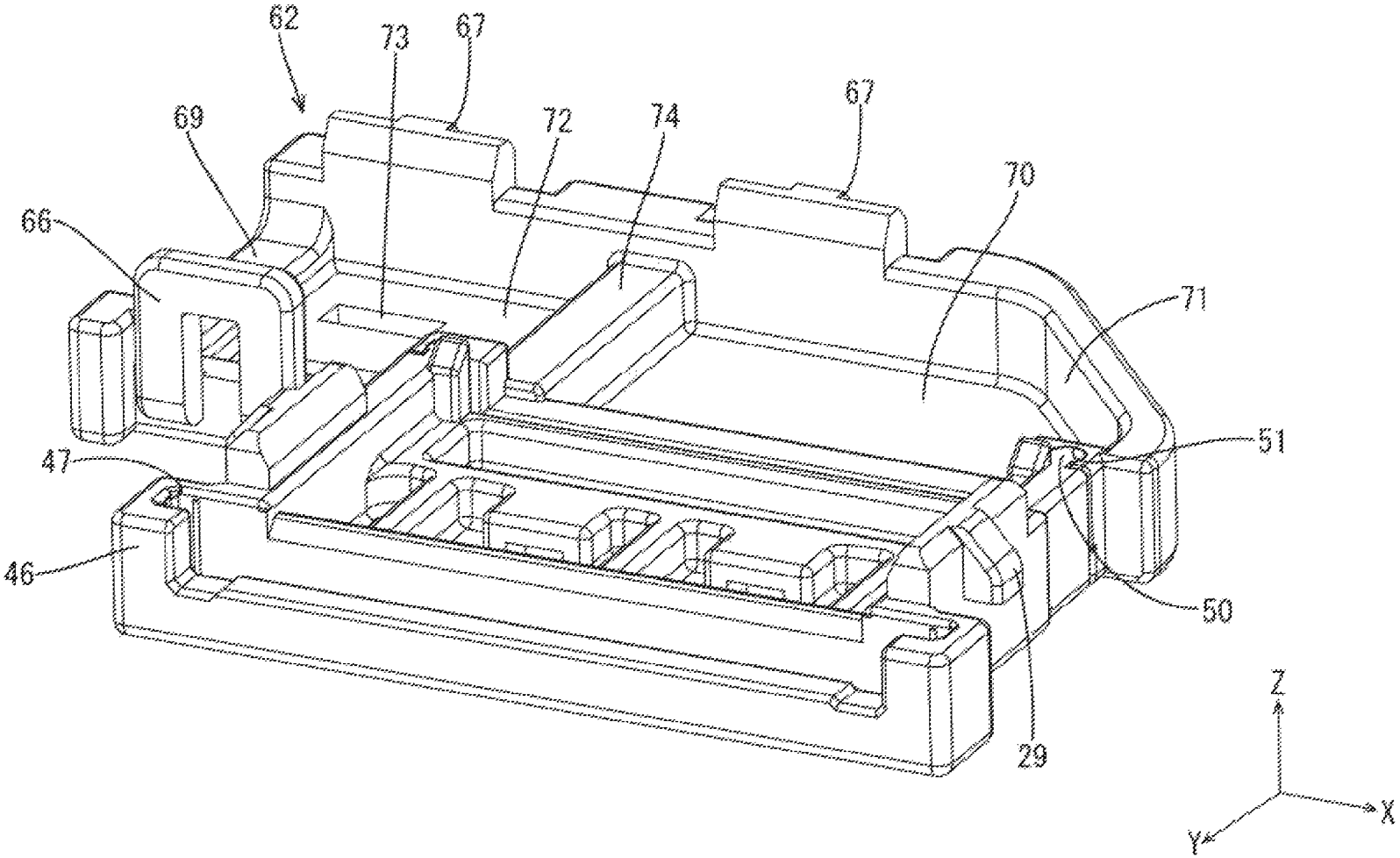
FIG. 30 is a perspective view illustrating the second cover in the state where a second engaging part and a second engaged part are engaged.
Figure 31:
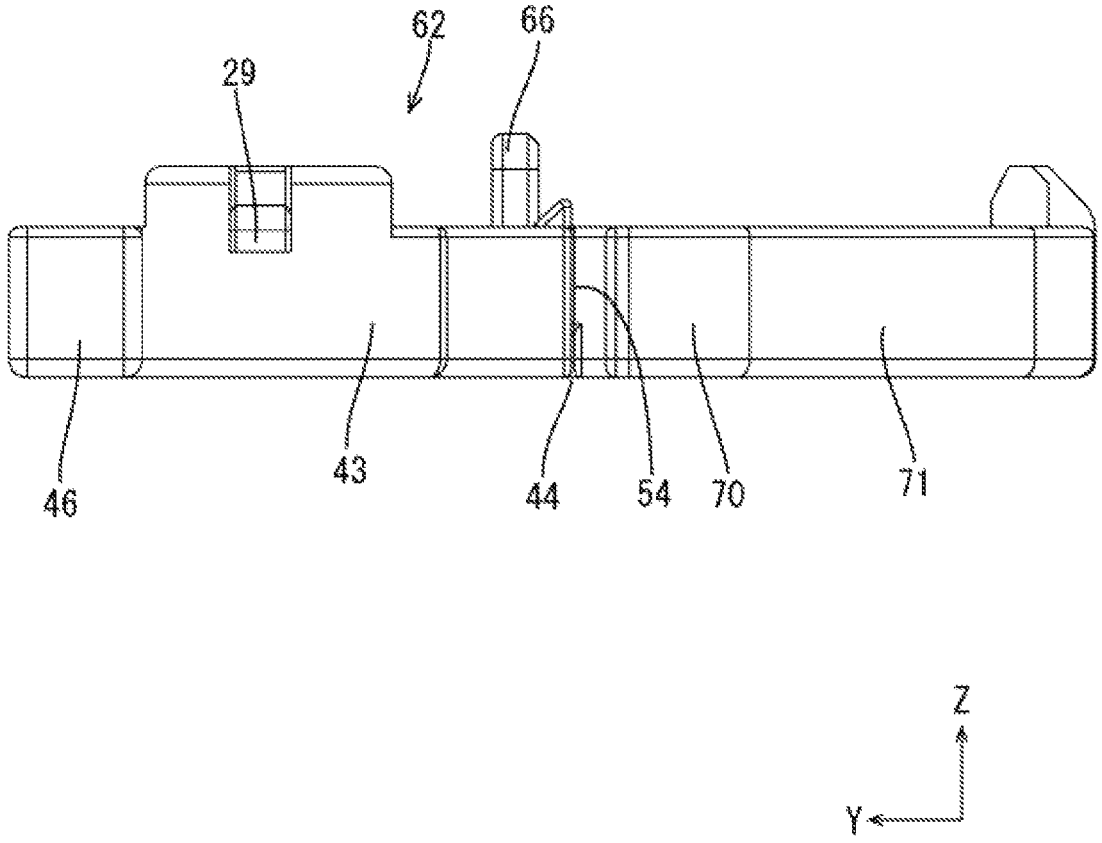
FIG. 31 is a side view illustrating the second cover in the state where the second engaging part and the second engaged part are engaged.
Figure 32:
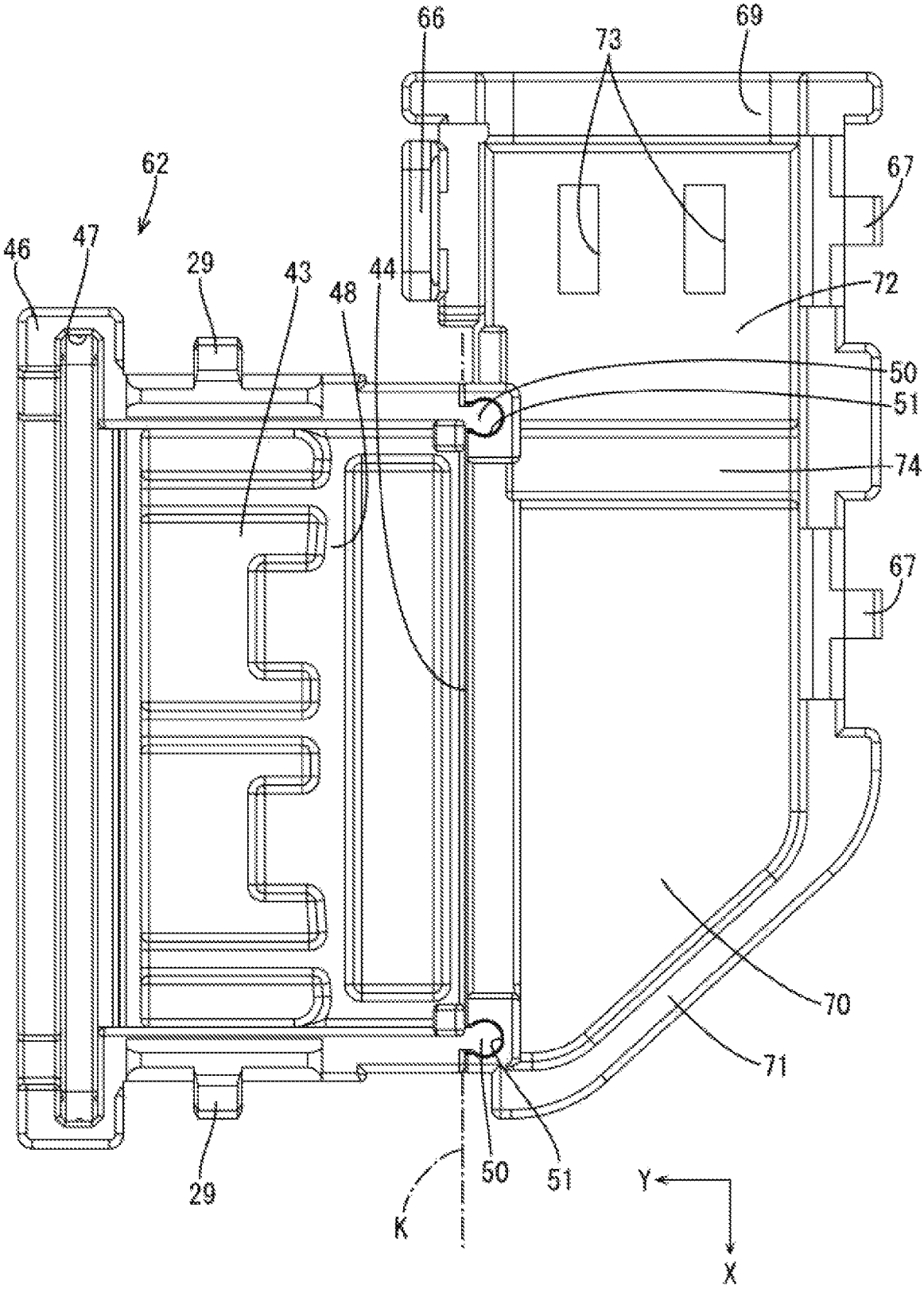
FIG. 32 is a plan view illustrating the second cover in the state where the second engaging part and the second engaged part are engaged.

Next, a second embodiment of the technology described herein will be described with reference to FIG. 22 to FIG. 32. As illustrated in FIG. 22, a connector 80 according to the present embodiment includes the connector housing 12 and an electric cable cover 60. The electric cable cover 60 includes a first cover 61 and a second cover 62 that are connected to each other.

First Cover 61

As illustrated in FIG. 23 to FIG. 27, a first rotation part 63 of the first cover 61 has a substantially trapezoidal shape when viewed from above. A left side of an upper wall of the first rotation part 63 is inclined to the right as the left side is extended from the front to the back. A left side wall 64 formed at the left side of the upper wall is also inclined to the right as the left side wall is extended from the front to the back. Thus, the electric cables 11 led out from the rear end part of the connector housing 12 to the back are bent to the right by the electric cables 11 are brought into contact with the inner surface of the left side wall 64.

The first rotation part 63 includes a first extension part 65 that is extended further to the right than a right end part of the first base part 23 is. At a rear end part of the first rotation part 63, two base part side lock parts 66 are provided with a space formed therebetween in the left-right direction. One of the two base part side lock parts 66 provided at the rear end part of the first rotation part 63 is provided at the rear end part of the first extension part 65.

At a front end part of the first extension part 65, a base part side lock receiving part 67 is provided to project to the front.

At a right end part of the first extension part 65, a right side wall that is extended downward is formed. At a lower edge of the right side wall, a first concave part 68 that is depressed upward is formed. This first concave part 68 and a second concave part 69 provided to the second cover 62 to be described below form a lead-out port (not shown) together. Through this lead-out port, the electric cables 11 are led out.

Second Cover 62

As illustrated in FIG. 28 to FIG. 32, a second rotation part 70 of the second cover 62 has a substantially trapezoidal shape when viewed from below. A left side of a lower wall of the second rotation part 70 is inclined to the right as the left side is extended from the front to the back. A left side wall 71 formed at the left side of the lower wall is also inclined to the right as the left side wall is extended from the front to the back. Thus, the electric cables 11 led out from the rear end part of the connector housing 12 to the back are bent to the right as the electric cables 11 are brought into contact with the inner surface of the left side wall 71.

The second rotation part 70 includes a second extension part 72 that is extended further to the right than a right end part of the second base part 43 is. At a rear end part of the second rotation part 70, two base part side lock receiving parts 67 are provided with a space formed therebetween in the left-right direction. One of the two base part side lock receiving parts 67 provided at the rear end part of the second rotation part 70 is provided at the rear end part of the second extension part 72.

At a front end part of the second extension part 72, the base part side lock part 66 that forms a gate shape when viewed from the front is provided.

At a right end part of the second extension part 72, a right side wall that is extended upward is formed. At an upper edge of the right side wall, a second concave part 69 that is depressed downward is formed.

A lower wall of the second extension part 72 includes two tie band insertion holes 73. The tie band insertion holes 73 are extended in the left-right direction and are arranged with a space formed therebetween in the front-back direction. The tie band insertion holes 73 are formed penetrating the lower wall of the second extension part 72.

On the lower wall of the second rotation part 70, a clamping part 74 is provided at a position on the left side of the second extension part 72. The clamping part 74 is extended in the front-back direction and has a rib shape that projects upward. In a state where the first cover 61 and the second cover 62 are attached to the rear end part of the connector housing 12, the electric cables 11 are clamped between an inner wall of the second cover 62 and the clamping part 74.

The other configurations are substantially the same as those in the first embodiment; thus, the same components are denoted by the same reference sign and the description is not repeated.

According to the present embodiment, the electric cables 11 led out from the rear end part of the connector housing 12 to the back can be bent to a direction (to the right) that is different from the direction (to the back) where the electric cables 11 are led out from the connector housing 12.

Third Embodiment

Next, a third embodiment of the technology described herein will be described with reference to FIG. 33 to FIG. 35. A connector 85 according to the present embodiment includes the connector housing 12 and an electric cable cover 86. The electric cable cover 86 is formed by combining a first cover 87 and a second cover 88.

First Cover 87

In the first cover 87 according to the present embodiment, the first base part 23 and the first rotation part 25 are rotatably linked by a pair of first hinges 89. The first hinges 89 are formed to be integrated with the first base part 23 and the first rotation part 25.

Figure 33:
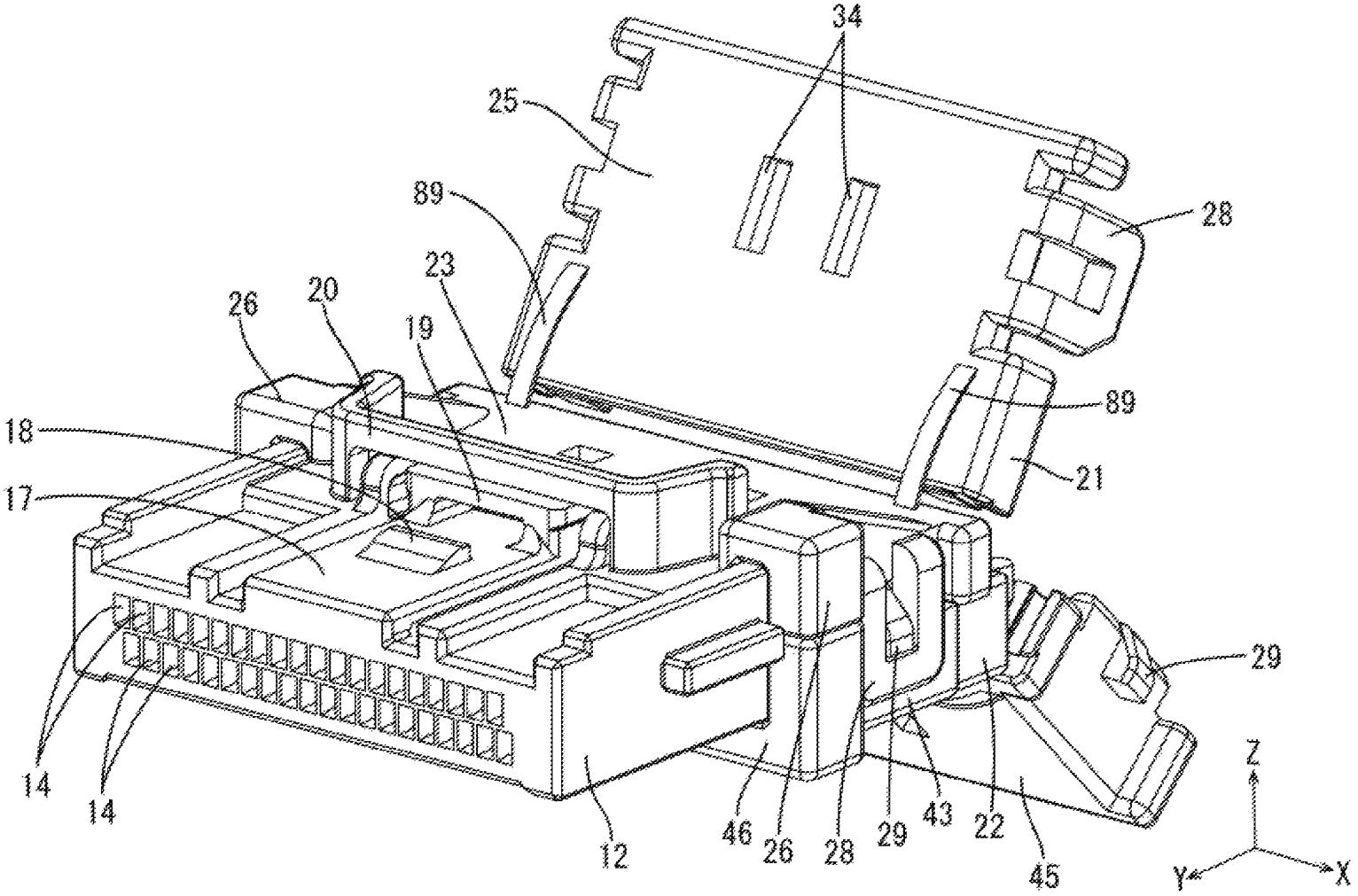
FIG. 33 is a perspective view illustrating a state where a first cover and a second cover are attached to a connector housing according to a third embodiment.

As illustrated in FIG. 33, each front end part of the pair of first hinges 89 is extended from the rear end part of the first base part 23 near a left or right end. In addition, each rear end part of the pair of first hinges 89 is extended from slightly rear position of the front end part of the first rotation part 25. The pair of first hinges 89 is formed in a band-like shape that is extended long and thin in the front-back direction. The pair of first hinges 89 has the same length in the front-back direction.

Second Cover 88

In the second cover 88 according to the present embodiment, the second base part 43 and the second rotation part 45 are rotatably linked by a pair of second hinges 90. The second hinges 90 are formed to be integrated with the second base part 43 and the second rotation part 45.

Figure 34:
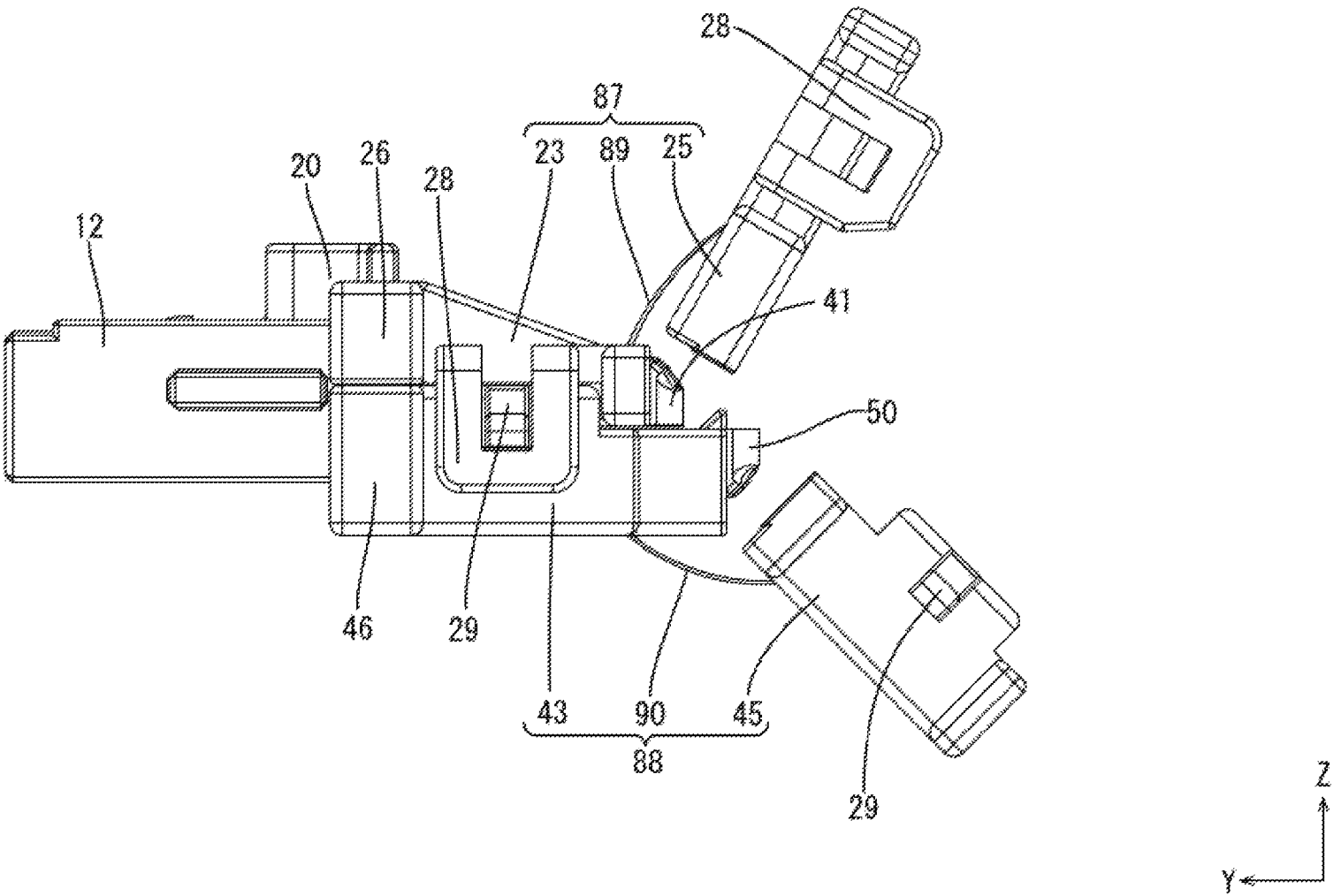
FIG. 34 is a side view illustrating the state where the first cover and the second cover are attached to the connector housing.

As illustrated in FIG. 34, each front end part of the pair of second hinges 90 is extended from slightly front position from the rear end part of the second base part 43 near a left or right end. In addition, each rear end part of the pair of second hinges 90 is extended from a position near the front end part of the second rotation part 45. The pair of second hinges 90 is formed in a band-like shape that is extended long and thin in the front-back direction. The pair of second hinges 90 has the same length in the front-back direction.

Figure 35:
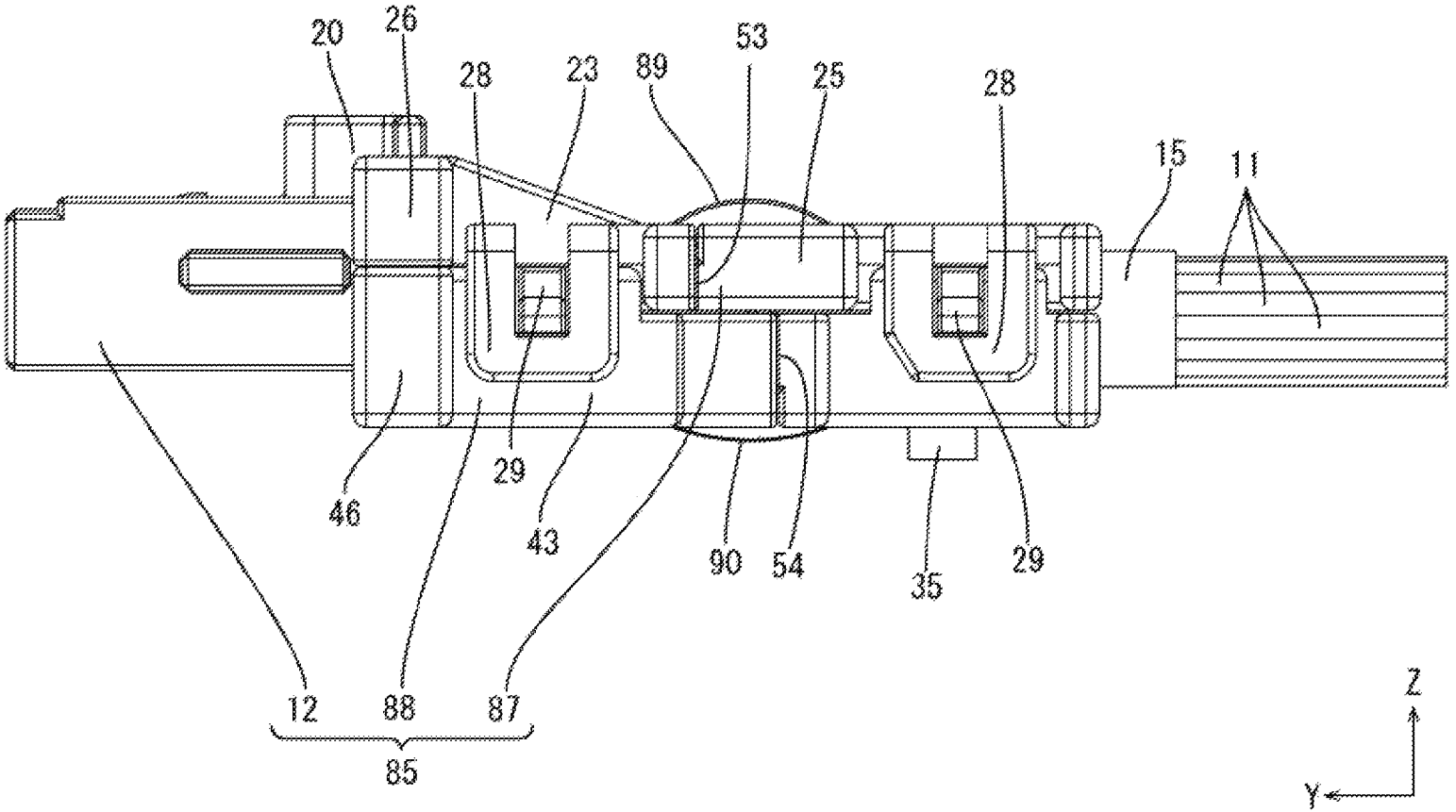
FIG. 35 is a side view illustrating the connector.

As illustrated in FIG. 35, in a state where the first cover 87 and the second cover 88 are assembled to the connector housing 12 and the first rotation part 25 and the second rotation part 45 are connected to each other, the first hinges 89 and the second hinges 90 are disposed at the same position in regard to the front-back direction and the left-right direction. The first hinge 89 and the second hinge 90 have the same length in the front-back direction.

The other configurations are substantially the same as those in the first embodiment; thus, the same components are denoted by the same reference sign and the description is not repeated.

According to the present embodiment, even in the case where the first hinges 89 and the second hinges 90 are disposed at the same position in regard to the front-back direction and the left-right direction, the first border region 53 and the second border region 54 are provided at different positions (positions displaced in regard to the front-back direction). Thus, the first rotation part 25 is supported by the second base part 43 and the second rotation part 45 is supported by the first rotation part 25. Thus, the deformation of the electric cable cover 86 as a whole can be suppressed; accordingly, the strength of the electric cable cover 86 can be improved.

Fourth Embodiment

Next, a fourth embodiment according to the technology described herein will be described with reference to FIG. 36 to FIG. 38. A connector 95 according to the present embodiment includes the connector housing 12 and an electric cable cover 96. The electric cable cover 96 is formed by connecting a first cover 97 and a second cover 98.

First Cover 97

In the first cover 97 according to the present embodiment, the first base part 23 and the first rotation part 63 are rotatably linked by a pair of first hinges 99. The first hinges 99 are formed to be integrated with the first base part 23 and the first rotation part 63.

Figure 36:
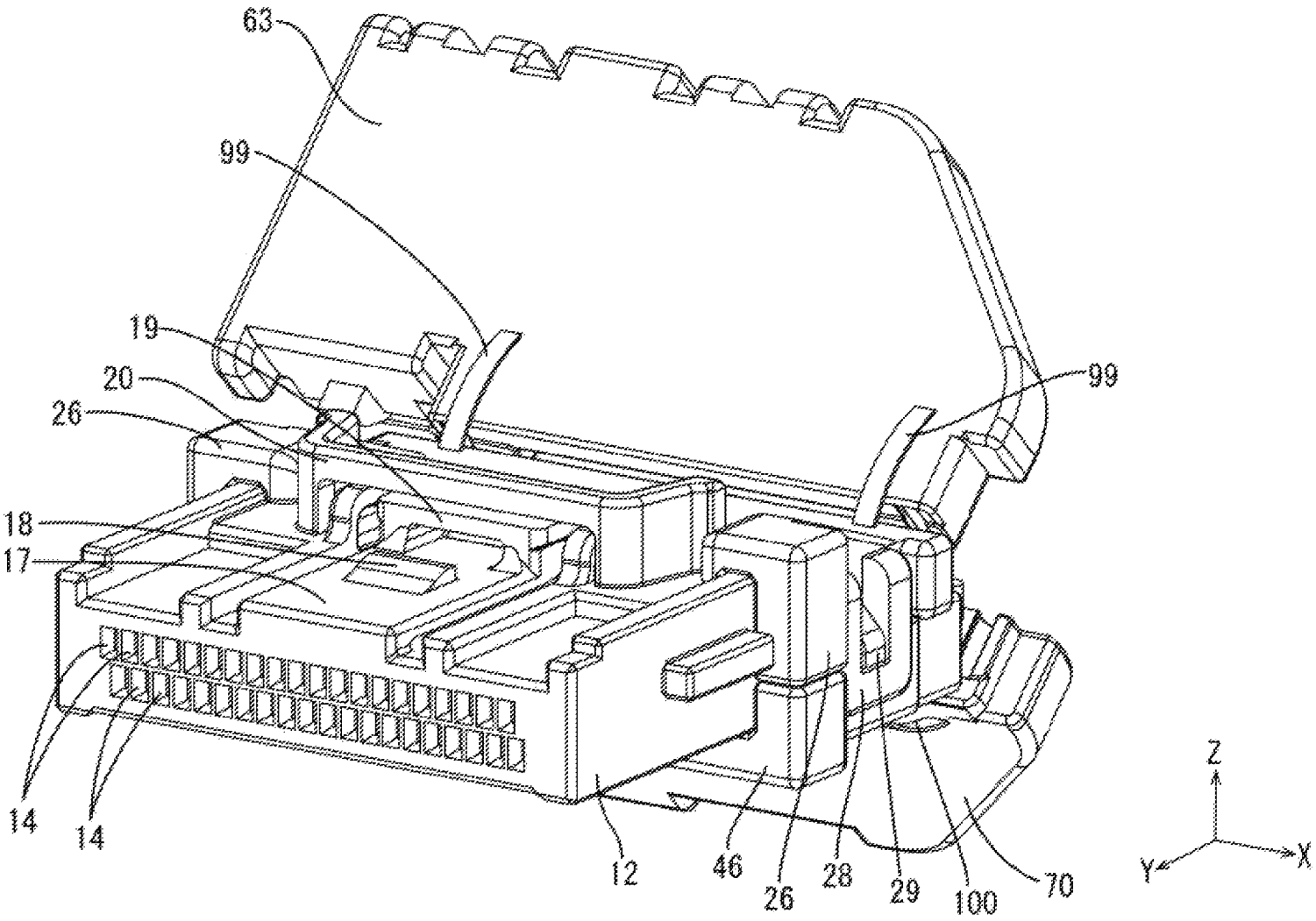
FIG. 36 is a perspective view illustrating a state where a first cover and a second cover are attached to a connector housing according to a fourth embodiment.

As illustrated in FIG. 36, each front end part of the pair of first hinges 99 is extended from the rear end part of the first base part 23 near a left or right end. In addition, each rear end part of the pair of first hinges 99 is extended from slightly rear position of the front end part of the first rotation part 63. The pair of first hinges 99 is formed in a band-like shape that is extended long and thin in the front-back direction. The pair of first hinges 99 has the same length in the front-back direction.

Second Cover 98

In the second cover 98 according to the present embodiment, the second base part 43 and the second rotation part 70 are rotatably linked by a pair of second hinges 100. The second hinges 100 are formed to be integrated with the second base part 43 and the second rotation part 70.

Figure 37:
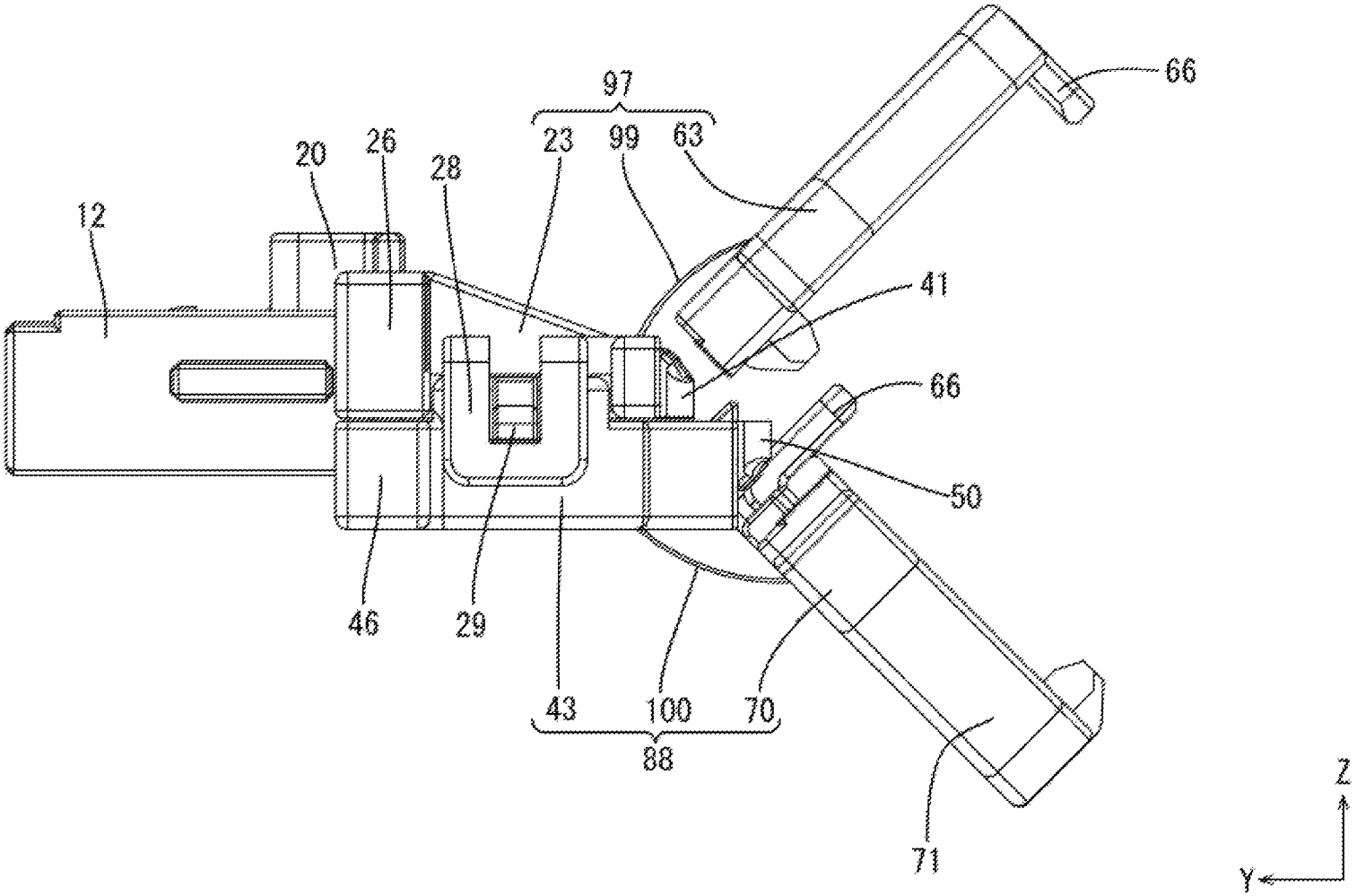
FIG. 37 is a side view illustrating a state where the first cover and the second cover are attached to the connector housing.

As illustrated in FIG. 37, each front end part of the pair of second hinges 100 is extended from slightly front position of the rear end part of the second base part 43 near a left or right end. In addition, each rear end part of the pair of second hinges 100 is extended from a position near the front end part of the second rotation part 70. The pair of second hinges 100 is formed in a band-like shape that is extended long and thin in the front-back direction. The pair of second hinges 100 has the same length in the front-back direction.

Figure 38:
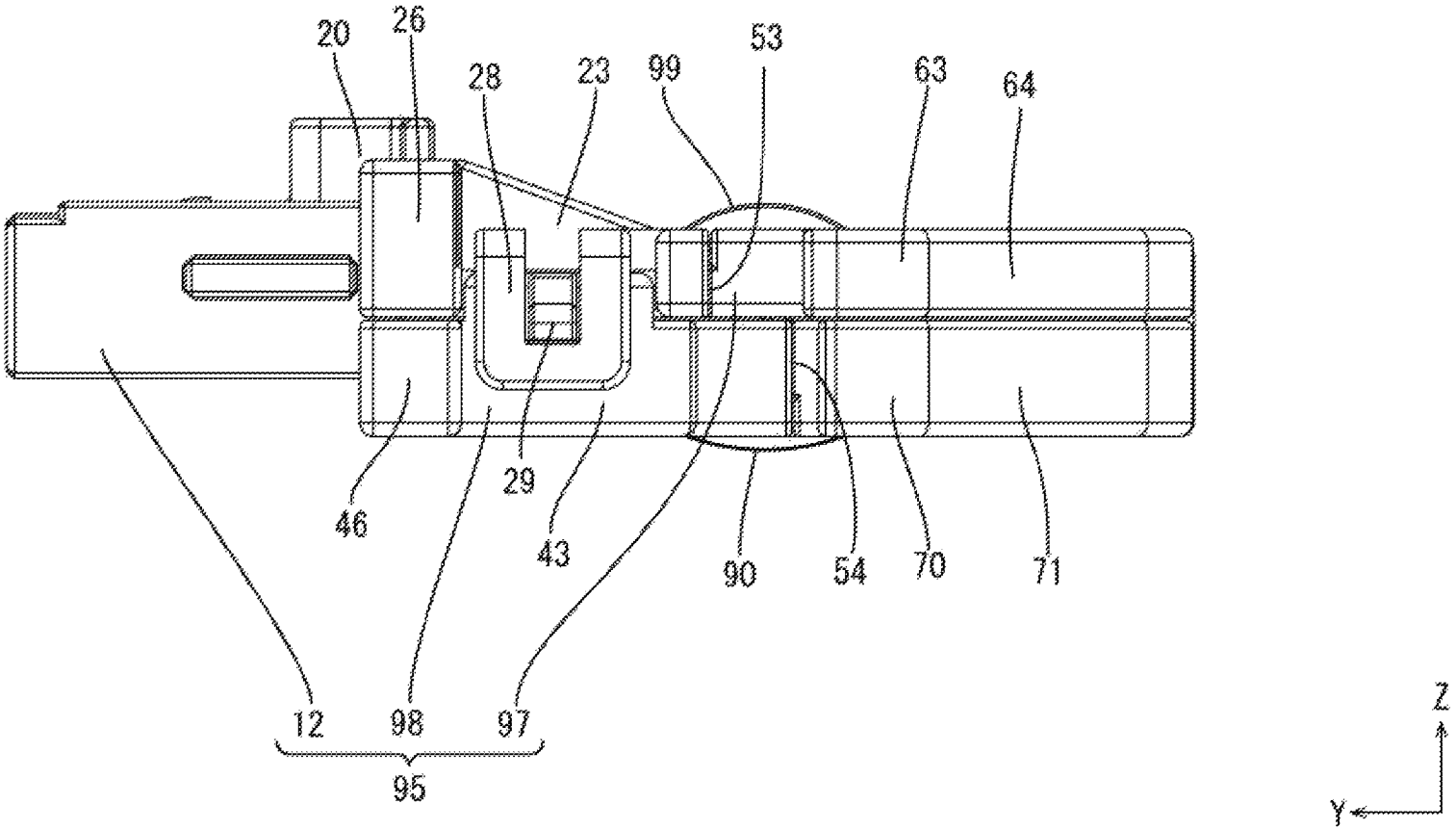
FIG. 38 is a side view illustrating the connector.

As illustrated in FIG. 38, in a state where the first cover 97 and the second cover 98 are assembled to the connector housing 12 and the first rotation part 63 and the second rotation part 70 are connected to each other, the first hinges 99 and the second hinges 100 are disposed at the same position in regard to the front-back direction and the left-right direction. The first hinge 99 and the second hinge 100 have the same length in the front-back direction.

The other configurations are substantially the same as those in the second embodiment; thus, the same components are denoted by the same reference sign and the description is not repeated.

According to the present embodiment, even in the case where the first hinges 99 and the second hinges 100 are disposed at the same position in regard to the front-back direction and the left-right direction, the first border region 53 and the second border region 54 are provided at different positions (positions displaced in regard to the front-back direction). Thus, the first rotation part 63 is supported by the second base part 43 and the second rotation part 70 is supported by the first rotation part 63. Thus, the deformation of the electric cable cover 96 as a whole can be suppressed; accordingly, the strength of the electric cable cover 96 can be improved.

Other Embodiments

The technology described herein is not limited to the embodiments described above and with reference to the drawings. The following embodiments may be included in the technical scope.

(1) In the above embodiments, the electric cable cover is formed by connecting the first cover and the second cover. However, the configuration is not limited to this example, and the electric cable cover may be formed by connecting three or more split covers.

(2) In the above embodiments, the engaging part is provided to the base part and the engaged part is provided to the rotation part. However, the configuration is not limited to this example, and the engaged part may be provided to the base part and the engaging part may be provided to the rotation part. Alternatively, the engaging part and the engaged part may be omitted.

(3) In the above embodiments, the clamping part is provided to the second cover. However, the configuration is not limited to this example, and the clamping part may be provided to the first cover. Alternatively, the clamping part may be provided to both the first cover and the second cover. Further alternatively, the clamping part may be omitted.

(4) In the first embodiment and the second embodiment, the first hinge 24 and the second hinge 44 are provided at positions displaced in regard to the direction where the electric cables 11 are led out from the connector housing 12 (front-back direction). However, the configuration is not limited to this example, and the first hinge 24 and the second hinge 44 may be provided at positions displaced in regard to the direction where the electric cables 11 are led out from the electric cable cover 13. For example, in the case where the electric cables 11 led out from the connector housing 12 to the back are bent in the electric cable cover 60 and led out from the electric cable cover 60 to the right as described in the second embodiment, the first hinge and the second hinge extended in the front-back direction may be formed displaced in the left-right direction.

The first hinge and the second hinge may be extended in different directions.

(5) In the first embodiment, the tie band insertion holes 34 and 52 are provided to both the first cover 21 and the second cover 22. However, the tie band insertion holes may be omitted.

(6) In the first embodiment, the tie band 35 is inserted into the tie band insertion hole 52 of the second cover 22. However, the configuration is not limited to this example, and the tie band 35 may be inserted into the tie band insertion hole 34 provided to the first rotation part 25.

(7) In the above embodiments, the cavities 14 are provided in two stages in the up-down direction. However, the configuration is not limited to this example, and the cavities 14 may be provided in one stage, or in three or more stages in the up-down direction.

(8) In the first and second embodiments, the width of the hinge in the left-right direction is smaller than the width of the base part and the rotation part in the left-right direction. However, the configuration is not limited to this example, and the width of the hinge may be equal to the width of the base part or the rotation part.

In the first and second embodiments, the thickness of the hinge is smaller than the thickness of the base part and the rotation part. However, the configuration is not limited to this example, and the thickness of the hinge may be equal to the thickness of the base part and the thickness of the rotation part.

(9) In the above embodiments, the base part and the rotation part are rotatably linked by one or two hinges. However, the configuration is not limited to this example, and three or more hinges may be provided.

What is claimed is:

1. An electric cable cover that is to be mounted on a connector housing that has opposite front and rear ends and the electric cable cover being configured to cover an electric cable led out from the rear end of the connector housing, the electric cable cover comprising:

first and second split covers that are connectable to each other, each of the split covers each including:

a base part that is to be attached to the connector housing;

a hinge with flexibility that is integral with the base part; and a rotation part that is contiguous to the hinge and rotates using a rotation axis of the hinge as a center, wherein in a state where the first and second split covers are connected to each other, a border region between the base part and the rotation part of the first rotation cover is provided at a first distance from the front end of the connector housing and a border region between the base part and the rotation part of the second rotation cover is provided at a second distance from the front end of the connector housing, the first distance being different from the second distance.

2. The electric cable cover according to claim 1, wherein at least one of the base part and the rotation part of the first split cover includes an engaging part, and at least one of the base part and the rotation part of the second split cover includes an engaged part that is engaged with the engaging part of the first split cover.

3. The electric cable cover according to claim 1, wherein the first split covers includes a clamping part that clamps the electric cable between the clamping part and second split cover in contact with the electric cable in the state where the of first and second split covers are connected to each other.

4. A connector comprising:

the electric cable cover according to claim 1; and a connector housing on which the electric cable cover is mounted.

* * * * *